US009399809B2

(12) United States Patent
Teraoka et al.

(10) Patent No.: US 9,399,809 B2
(45) Date of Patent: Jul. 26, 2016

(54) HOT ROLLED FERRITIC STAINLESS STEEL SHEET, METHOD FOR PRODUCING SAME, AND METHOD FOR PRODUCING FERRITIC STAINLESS STEEL SHEET

(75) Inventors: Shinichi Teraoka, Kitakyushi (JP); Masaaki Kobayashi, Kitakyushu (JP); Yuuji Koyama, Kitakyushu (JP); Junichi Hamada, Hikari (JP); Norihiro Kanno, Hikari (JP); Yoshiharu Inoue, Kisarazu (JP); Ken Kimura, Kimitsu (JP); Jun Takahashi, Kisarazu (JP); Shigeyuki Gotoh, Kitakyushu (JP)

(73) Assignee: NIPPON STEEL & SUMIKIN STAINLESS STEEL CORPORATION, Tokyo (JP)

( * ) Notice: Subject to any disclaimer, the term of this patent is extended or adjusted under 35 U.S.C. 154(b) by 276 days.

(21) Appl. No.: 13/981,395

(22) PCT Filed: Feb. 8, 2012

(86) PCT No.: PCT/JP2012/052901

§ 371 (c)(1),
(2), (4) Date: Jul. 24, 2013

(87) PCT Pub. No.: WO2012/108479

PCT Pub. Date: Aug. 16, 2012

(65) Prior Publication Data

US 2013/0306204 A1 Nov. 21, 2013

(30) Foreign Application Priority Data

Feb. 8, 2011 (JP) ..... 2011-024872
Feb. 9, 2011 (JP) ..... 2011-026277
Feb. 24, 2011 (JP) ..... 2011-038252
Feb. 7, 2012 (JP) ..... 2012-024544

(51) Int. Cl.
*C22C 38/20* (2006.01)
*C22C 38/28* (2006.01)
(Continued)

(52) U.S. Cl.
CPC . *C22C 38/54* (2013.01); *B21B 1/26* (2013.01); *C21D 6/002* (2013.01); *C21D 6/004* (2013.01); *C21D 6/005* (2013.01); *C21D 6/008* (2013.01);
(Continued)

(58) Field of Classification Search
None
See application file for complete search history.

(56) References Cited

U.S. PATENT DOCUMENTS

2009/0092513 A1* 4/2009 Hamada ..... C21D 6/002 420/61

FOREIGN PATENT DOCUMENTS

CN 101328561 12/2008
CN 101680066 3/2010
(Continued)

OTHER PUBLICATIONS

Office Action dated Mar. 10, 2014 issued in Chinese Application No. 201280007705.5 [with English Translation].
(Continued)

*Primary Examiner* — Deborah Yee
(74) *Attorney, Agent, or Firm* — Kenyon & Kenyon LLP

(57) ABSTRACT

This hot-rolled ferritic stainless steel sheet has a steel composition containing, in terms of % by mass: 0.02% or less of C; 0.02% or less of N; 0.1% to 1.5% of Si; 1.5% or less of Mn; 0.035% or less of P; 0.010% or less of S; 1.5% or less of Ni; 10% to 20% of Cr; 1.0% to 3.0% of Cu; 0.08% to 0.30% of Ti; and 0.3% or less of Al, with the balance being Fe and unavoidable impurities, and the hot-rolled ferritic stainless steel sheet has a Vickers hardness of less than 235 Hv.

8 Claims, 5 Drawing Sheets

(51) Int. Cl.

| | |
|---|---|
| ***C21D 8/02*** | (2006.01) |
| ***C22C 38/54*** | (2006.01) |
| ***C22C 38/50*** | (2006.01) |
| ***C22C 38/42*** | (2006.01) |
| ***C22C 38/48*** | (2006.01) |
| ***C22C 38/44*** | (2006.01) |
| ***C22C 38/46*** | (2006.01) |
| ***C22C 38/06*** | (2006.01) |
| ***C22C 38/04*** | (2006.01) |
| ***C22C 38/02*** | (2006.01) |
| ***C22C 38/00*** | (2006.01) |
| ***B21B 1/26*** | (2006.01) |
| ***C21D 6/00*** | (2006.01) |
| ***C21D 9/46*** | (2006.01) |
| ***C22C 38/22*** | (2006.01) |
| ***C22C 38/26*** | (2006.01) |
| ***C22C 38/32*** | (2006.01) |
| ***C22C 38/38*** | (2006.01) |

(52) U.S. Cl.

CPC ..... *C21D 8/0263* (2013.01); *C21D 9/46* (2013.01); *C22C 38/001* (2013.01); *C22C 38/004* (2013.01); *C22C 38/02* (2013.01); *C22C 38/04* (2013.01); *C22C 38/06* (2013.01); *C22C 38/20* (2013.01); *C22C 38/22* (2013.01); *C22C 38/26* (2013.01); *C22C 38/28* (2013.01); *C22C 38/32* (2013.01); *C22C 38/38* (2013.01); *C22C 38/42* (2013.01); *C22C 38/44* (2013.01); *C22C 38/46* (2013.01); *C22C 38/48* (2013.01); *C22C 38/50* (2013.01); *C21D 8/0226* (2013.01); *C21D 8/0236* (2013.01)

(56) References Cited

FOREIGN PATENT DOCUMENTS

| | | |
|---|---|---|
| EP | 1413640 | 4/2004 |
| JP | 64-056822 | 3/1989 |
| JP | 05-320764 | 12/1993 |
| JP | 2562740 | 12/1996 |
| JP | 2696584 | 1/1998 |
| JP | 2803538 | 9/1998 |
| JP | 10-273731 | 10/1998 |
| JP | 11-006036 | 1/1999 |
| JP | 2880839 | 4/1999 |
| JP | 2959934 | 10/1999 |
| JP | 3021656 | 3/2000 |
| JP | 2000-297355 | 10/2000 |
| JP | 2001-026826 | 1/2001 |
| JP | 2002-194507 | 7/2002 |
| JP | 2004-068118 | 3/2004 |
| JP | 2004-099926 | 4/2004 |
| JP | 2004-107704 | 4/2004 |
| JP | 2006-274436 | 10/2006 |
| JP | 2007-262460 | 10/2007 |
| JP | 2008-240143 | 10/2008 |
| JP | 2010-024509 | 2/2010 |
| JP | 2012-140688 | 7/2012 |
| WO | 03/004714 | 1/2003 |

OTHER PUBLICATIONS

Office Action dated Sep. 24, 2014 issued in Japanese Application No. 2011-026277 [with English Translation].

International Search Report dated May 1, 2012 issued in corresponding PCT Application No. PCT/JP2012/052901 [With English Translation].

Koji Kishida and Osamu Akisue, "Effect of Copper Content on Mechanical Properties of Continuously Annealed Extra-low-carbon Titanium-added Steel Sheets", Iron and Steel, vol. 76 (1990), No. 5, pp. 759-766.

* cited by examiner

HOT ROLLED FERRITIC STAINLESS STEEL SHEET, METHOD FOR PRODUCING SAME, AND METHOD FOR PRODUCING FERRITIC STAINLESS STEEL SHEET

TECHNICAL FIELD

The present invention relates to a hot rolled ferritic stainless steel sheet, a method for producing the same, and a method for producing a ferritic stainless steel sheet.

This application is a national stage application of International Application No. PCT/JP2012/052901, filed Feb. 8, 2012, which claims priority to Japanese Patent Application No. 2011-024872 filed on Feb. 8, 2011, Japanese Patent Application No. 2011-026277 filed on Feb. 9, 2011, Japanese Patent Application No. 2011-038252 filed on Feb. 24, 2011 and Japanese Patent Application No. 2012-024544 filed on Feb. 7, 2012, the contents of which are incorporated herein by reference.

BACKGROUND ART

Generally, a stainless steel excellent in oxidation resistance and corrosion resistance has been used for a member used in an exhaust gas flow passage of a vehicle. Particularly, with regard to an upper stream member in the exhaust gas flow passage in which a working temperature is high, for example, members for exhaust systems such as an exhaust gas manifold, a catalytic converter, a front pipe, and the like, a high-temperature exhaust gas is discharged from an engine passes therethrough; and therefore, various characteristics such as high oxidation resistance, high-temperature strength, and heat-resistant fatigue characteristics are demanded.

In the related art, as disclosed in Patent Documents 1 to 6, a material SUS429 (14Cr—Nb steel) in which Nb is added to increase the high-temperature strength, a material SUS444 (19Cr—Nb—Mo steel) in which Mo is added together with Nb, and the like have been used for the above-described members for the vehicle exhaust system. In all of the materials, addition of Nb is assumed. This is to be because the high-temperature strength is increased by solid-solution strengthening or precipitation strengthening due to Nb or Mo.

The SUS429 steel is a stainless steel of a relatively low alloy; and therefore, workability is excellent. However, the usage environment thereof is limited to a portion in which the maximum achieving temperature is in a range of 750° C. or lower. In addition, the SUS444 steel has a strong high-temperature strength that may withstand the maximum achieving temperature of 850° C.; however, there is a problem in that workability is inferior to the SUS429 steel.

Therefore, in recent years, as disclosed in Patent Documents 7 and 8, as an intermediate grade material between the SUS429 steel and the SUS444 steel, a composite addition steel of Nb—Cu and Nb—Ti—Cu has been developed in which the heat resistance that is the problem of the SUS429 steel is improved and a decrease in workability is reduced. Characteristics of the composite addition steel are as follows. The high-temperature strength is increased by utilizing the solid-solution strengthening and the precipitation strengthening of Cu, and workability is improved by decreasing an added amount of Nb or Mo compared to SUS444.

Here, the precipitation strengthening of Cu as described above is exhibited in the middle of the usage under a high-working-temperature environment in the members for the exhaust system and the like after processing the composite addition steel, and when being processed into the members for the exhaust system, Cu is generally solutionized (solid-solubilized). Therefore, the Cu-added steel is advantageous in workability compared to the Nb-added steel in which precipitates are difficult to be solutionized completely. In addition, Mo is easy to be solutionized completely in the production process as is the case with Cu. However, solid-solution strengthening ability of Mo at an ordinary temperature is higher than that of Cu, and workability of Mo is lower than that of Cu. Furthermore, Mo and Nb are elements that are more expensive than Cu; and therefore, substitution by Cu leads to cost reduction of an alloy.

Generally, the ferritic stainless steel has low toughness compared to a common steel. Therefore, when a hot-rolled coil is uncoiled, and the resultant thin sheet is passed through respective processes such as cold rolling, pickling, and annealing, cold cracking such as edge cracking and sheet fracture may occur. In view of the circumstance, optimization of hot-rolling and coiling conditions is performed so as to secure the toughness of the hot-rolled sheet. In addition, in a stainless steel containing Nb or Mo, the toughness of the hot-rolled sheet decreases due to precipitates of which a precipitation noze is in a range of 650° C. to 700° C., for example, a Laves phase ($Fe_2Nb$, $Fe_2Mo$) or $Fe_3Nb_3C$; and therefore, coiling is generally performed at a temperature of 550° C. or lower.

In addition, even in a steel in which 1% or more of Cu is added, there is a problem in that the toughness decreases due to the precipitates of Cu.

For example, Patent Document 9 discloses a technology of improving toughness by setting the coiling temperature to be in a range of 550° C. or lower with regard to a Cu-added non-oriented electrical steel sheet. In addition, in a specific example, it is disclosed that the toughness is improved when coiling is performed at 500° C., 520° C., or 540° C.

On the other hand, with regard to a material of the Cu-added steel, review has been made with a focus on a carbon steel.

For example, Non-Patent Document 1 discloses an effect of Cu on material characteristics of a Ti-added ultralow-carbon steel sheet. Specifically, Non-Patent Document 1 discloses that with regard to a steel containing 1.3% of Cu, in the case where a coiling temperature of a hot-rolled sheet is set to R. T. (room temperature), the Lankford value (r value) increases to the highest degree, and the r value decreases in the order of the case of coiling at 550° C. and the case of coiling at 780° C. In addition, with regard to a texture at that point of time, an effect of the coiling temperature on a texture in a (222) orientation is not recognized; however, amounts of textures in (211) and (200) orientations become the lowest values in the case where the coiling temperature is set to R. T.

In order to improve the above-described characteristics, a ferritic stainless steel sheet in which elements such as Cr and Mo are added as a main component has been developed. However, as described above, in recent years, Cu-added steel sheet has been developed.

Patent Document 10 discloses a cold-rolled stainless steel sheet for components of a vehicle exhaust system. In the cold-rolled stainless steel sheet, 1% by weight or more of Cu is added so as to utilize precipitation strengthening due to Cu precipitates in an intermediate temperature range and to utilize solid-solution strengthening due to solid-solubilized Cu in a high temperature range.

However, generally, when producing a steel sheet in which a large amount of Cu is added, cold cracking may occur in some cases; and therefore, deterioration in productivity caused by the cold cracking becomes problematic. Meanwhile, the cold cracking represents a phenomenon in which edge cracking or sheet fracture occurs due to deficiency in toughness of a hot-rolled coil when a steel sheet is allowed to pass through a continuous pickling line or a continuous annealing and pickling line after the hot-rolled coil is uncoiled.

Patent Document 11 discloses a technology with respect to a cold-rolled annealed sheet of a ferritic stainless steel containing 2.0% by mass or less of Cu; however, the toughness of the hot-rolled sheet is not implied. On the other hand, Patent Document 11 discloses a technology in which water cooling is performed immediately after hot rolling so as to suppress generation of precipitates in a cold-rolled sheet, and then the coiling treatment is performed.

However, Patent Document 11 does not disclose a coiling temperature and the like. In addition, it is difficult to cool to the vicinity of room temperature after hot rolling in light of a capability aspect of cooling equipment. In addition, a termination temperature of the water cooling is unclear, and practically applicable conditions are also unclear.

As a ferritic stainless steel in which the toughness of the hot-rolled steel is problematic, steel types in which the content of Cr is large or steel types in which Al is added may be exemplified, and as methods (techniques) for solving the toughness of these hot-rolled sheets, Patent Documents 12 to 14 are known.

As a technology of improving a toughness value of a hot-rolled sheet of steel types in which 25% by weight to 35% by weight of Cr is added, Patent Document 12 discloses a technology in which coiling is performed at a temperature of 400° C. to 600° C., and immediately after the coiling, rapid cooling is performed at a cooling rate higher than water cooling.

In addition, Patent Document 13 discloses a technology in which a ferritic stainless steel containing 3% by weight to 7% by weight of Al is subjected to rapid water-cooling after coiling.

Patent Document 14 discloses a method in which a steel sheet is coiled to have a coiled shape under a condition where the coiling temperature is set to be in a range of 550° C. to 650° C., and then the coil is immersed in a water bath within 3 hours from the coiling.

PRIOR ART DOCUMENT

Patent Document

Patent Document 1: Japanese Patent No. 2880839
Patent Document 2: Japanese Patent No. 3021656
Patent Document 3: Japanese Patent No. 2959934
Patent Document 4: Japanese Patent No. 2803538
Patent Document 5: Japanese Patent No. 2696584
Patent Document 6: Japanese Patent No. 2562740
Patent Document 7: PCT International Publication No. WO2003/004714
Patent Document 8: Japanese Unexamined Patent Application, First Publication No. 2008-240143
Patent Document 9: Japanese Unexamined Patent Application, First Publication No. 2010-24509
Patent Document 10: Japanese Unexamined Patent Application, First Publication No. 2000-297355
Patent Document 11: Japanese Unexamined Patent Application, First Publication No. 2002-194507
Patent Document 12: Japanese Unexamined Patent Application, First Publication No. H5-320764
Patent Document 13: Japanese Unexamined Patent Application, First Publication No. S64-56822
Patent Document 14: Japanese Unexamined Patent Application, First Publication No. 2001-26826

Non-Patent Document

Non-Patent Document 1: Iron and steel, volume 76 (1990), No. 5, pp 759-766

DISCLOSURE OF THE INVENTION

Problems to be Solved by the Invention

The present inventors have developed a material that contains a reduced amount of expensive metals Nb and Mo by mainly utilizing improvement of high-temperature strength due to addition of Cu. As a result, composite precipitation of a Laves phase and Cu is suppressed by reducing amounts of Nb and Mo, and the composite precipitation is regarded as a factor causing a decrease in toughness of a hot-rolled sheet. Furthermore, in the case where Cu finely precipitates, heat resistance and high-temperature strength can be enhanced even when Nb and Mo are not added or added in a small amount.

However, in the production of the Cu-added steel sheet, even general hot-rolled coiling conditions of a material for a vehicle exhaust system fulfill conditions of Patent Document 9; and therefore, it is considered that the toughness is not problematic. However, in a practically produced steel sheet, the toughness is low, and it is difficult for the steel sheet to pass through subsequent processes such as cold rolling, pickling, and annealing. That is, in the technology found in the related art, it is impossible to improve the toughness of the Cu-added stainless steel for heat resistance.

In addition, a problem of a decrease in workability compared to a steel in the related art is recognized. It is considered that when technical consideration of Non-Patent Document 1 may be applied to stainless steel, the r value of the stainless steel may be improved by performing coiling at a temperature close to R. T. However, practically, it is difficult to obtain a sufficient r value.

That is, the production technology to improve workability of the Cu-added steel sheet, which is known in the related art, is not sufficiently effective, and further improvement is needed.

In addition, as described above, as a technology of improving the toughness of the hot-rolled sheet, technologies of Patent Documents 3 and 5 are disclosed. However, when the present inventor applied the finding in the related art to steel types containing 1% or more of Cu, it is revealed that cold cracking may occur in some cases, and it is not necessarily effective for improvement of the toughness. That is, the technology of improving the toughness of the Cu-added steel sheet that is known in the related art is not sufficiently effective for a hot-rolled sheet of a ferritic stainless steel containing Cu in a large amount of 1% or more, and further improvement is needed.

Therefore, the present inventors have made the invention in consideration of the above-described circumstances, and an object thereof is to provide a hot-rolled ferritic stainless steel sheet in which high-temperature characteristics are improved by finely dispersing Cu precipitates, and excellent toughness is obtained by controlling hardness, a method for producing the same, and a method for producing a ferritic stainless steel sheet using the hot-rolled ferritic stainless steel sheet.

In addition, another object of the invention is to provide a hot-rolled ferritic stainless steel sheet having excellent cold cracking properties, and a method for producing the same.

Means for Solving the Problems

To solve the problems, the present inventors have examined in detail a precipitation behavior of Cu-based precipitates at a temperature of approximately 300° C. to 700° C., hardness, and toughness in a Cu-added hot-rolled ferritic stainless steel sheet in which a large amount of Nb and Mo are not added. In addition, the present inventors have repetitively performed various examinations to accomplish the above-described objects, and have obtained the following findings.

From the above-described examinations, the present inventors have found that in the case of the Cu-added ferritic stainless steel, nano-order sized Cu-rich clusters precipitate in a temperature range of 450° C. to 600° C.; and thereby, the toughness is dramatically decreased. That is, they have found that the toughness may be improved by preventing the precipitation of the Cu-rich clusters.

Here, as methods for preventing the precipitation of the Cu-rich clusters, the following two methods may be exemplified.

A first method is a method of setting a coiling temperature to be in a range of 620° C. or higher; and thereby, Cu is precipitated as ϵ-Cu in order to set hardness to be in a range of less than 235. Basically, ϵ-Cu is substantially harmless to the toughness of the hot-rolled sheet. It is considered that the Cu-rich clusters are formed during a process in which the Cu-based precipitates become the ϵ-Cu. However, for example, a holding time is set to be in a range of 10 minutes or more in the case where the coiling temperature is 650° C., and a holding time is set to be in a range of 60 seconds or more in the case where the coiling temperature is 700° C. Thereby, a considerable amount of the solid-solubilized Cu becomes ϵ-Cu; and as a result, toughness in a level capable of being passed through subsequent processes at a cold state (ordinary temperature) may be obtained. At this time, the hardness of the hot-rolled sheet after the coiling becomes soft to a degree of hardness of less than 235 Hv. However, compared to a state in which Cu is completely solid-solubilized, hardening is accomplished by precipitation strengthening due to Cu-based precipitates; and therefore, hardness of 200 Hv or more is obtained.

In addition, the coiling temperature is set to be in a range of 620° C. or higher as described above; and thereby, an amount of Cu that precipitates during a temperature-raising step in annealing (cold-rolled sheet annealing) after cold rolling becomes small, and a recrystallization texture having {222} plane direction can be sufficiently developed. Therefore, a steel sheet having excellent workability can be produced.

However, in the case where the coiling temperature is set to be in a range of 620° C. or higher, there is a problem in that a reduction amount in temperature (temperature drop) may become large at the innermost coiled portion (top portion) or the outermost coiled portion (bottom portion) of the hot-rolled coil after the coiling. As a result, the toughness of the respective portions of the hot-rolled coil decreases; and therefore, there is a concern that a difference in the toughness may occur in respective portions (specifically, respective portions of a top portion, a middle portion, and a bottom portion) in the hot-rolled coil. In the case where coiling is performed at 700° C., the holding time that is necessary is as short as 60 seconds. Therefore, it is considered that the temperature drop of the top portion or the bottom portion is not problematic. However, in the case where the coiling is performed at a temperature of higher than 750° C., oxidation of the hot-rolled sheet progresses. Accordingly, there is a problem in that in a subsequent pickling process after the coiling, a long period of time is necessary to remove oxidized scale on a surface of the hot-rolled sheet.

In addition, in the case where the coiling is performed at a temperature of lower than 650° C., the problem relating to the removal of the oxidized scale may be solved. However, there is a concern related to the temperature drop at the top portion and the bottom portion. Since this temperature drop varies depending on a hot-rolling coiler, a cooling method after coiling, or the like, it cannot be said that this temperature drop becomes problematic without reservation. However, in the case where there is a concern that a difference in toughness may occur due to the temperature drop of the respective portions in the hot-rolled coil, the cooling is controlled through appropriate adjustment of cooling conditions with respect to portions that become the top portion and the bottom portion of the hot-rolled coil when the hot-rolled steel sheet after finish rolling is mainly cooled with water. The adjustment is performed so as to obtain a temperature distribution of the hot-rolled steel sheet in which a temperature in the top portion and the bottom portion is higher than that of the middle portion. Then, the hot-rolled steel sheet is coiled in this temperature distribution state. As a result, the temperature drop at the top portion and the bottom portion can be made small. Accordingly, a variation in the toughness of the respective portions in the hot-rolled coil can be suppressed. That is, it is effective for a temperature hysteresis in the coil to fulfill Expression (1) to be described below in a temperature range of 620° C. to 750° C. over the entire length of the hot-rolled coil.

$$T(20.24+\log(t))\geq 17963 \quad (1)$$

T: temperature (K) of the hot-rolled steel sheet, and t: holding time (h)

The present inventors have found that when the coiling temperature after the hot rolling is optimized and the temperature hysteresis in the hot-rolled coil after the coiling is controlled as described above, a variation in toughness inside the hot-rolled coil can be suppressed; and thereby, satisfactory toughness of the hot-rolled sheet can be obtained. Furthermore, they have found that the texture in the {222} plane direction is developed after the cold-rolling annealing and the texture is advantageous for workability, and they have obtained a finding that the workability can be improved.

A second method of preventing precipitation of the Cu-rich clusters so as to improve the toughness of the hot-rolled sheet is a method in which after hot rolling, cooling is performed at a rate of 10° C./s or more in a temperature range of 800° C. to 500° C., and then coiling is performed under a condition where the coiling temperature is set to be in a range of 450° C. or lower. According to this, Cu is solid-solubilized; and thereby, satisfactory toughness of the hot-rolled sheet is obtained. However, in the case where the coiling temperature is set to be in a range of lower than 350° C., solid-solubilized C and solid-solubilized N are not sufficiently fixed as carbonitrides of Ti, Nb, or the like. Thereby, development of a recrystallization texture of {222} plane is prevented during cold-rolling annealing (cold-rolled sheet annealing). As a result, the Lankford value decreases, and there is a concern that workability may be deteriorated. Accordingly, in the case of solid-solubilizing Cu so as to improve toughness, it is necessary that the coiling temperature is set to be in a range of 350° C. to 450° C. for compatibility with workability of products.

As described above, the present inventors have found that when the coiling temperature after the hot rolling is optimized and the morphology of the Cu-based precipitates is controlled, high toughness of the hot-rolled sheet can be obtained. Furthermore, the present inventors have found that the texture in {222} plane direction which is advantageous for workability is developed after the cold-rolling annealing according to coiling conditions; and therefore, workability can be improved.

Furthermore, the present inventors have examined a relationship between hot-rolling coiling conditions of a ferritic stainless steel and the toughness of the hot-rolled sheet so as to solve the above-described problems.

First, in a laboratory, the present inventors hot-rolled ferritic stainless steels having various Cu contents to a thickness of 5 mm, and then they performed a coiling treatment while changing a coiling temperature in a range of 300° C. to 600° C. and a coiling time in a range of 0.1 hours to 100. Next, the ferritic stainless steels were cooled with water to an ordinary temperature after the coiling treatment to produce hot-rolled steel sheets. The obtained hot-rolled steel sheets were subjected to a Charpy test to evaluate toughness at an ordinary temperature (25° C.).

In addition, a relationship with toughness has been examined by giving attention to fine precipitates such as Cu-rich clusters (hereinafter, referred to as simply Cu clusters) that are present in the hot-rolled steel sheet produced under various conditions described above. The reason why this examination is performed is as follows. A great effect of the Cu-based precipitates on the toughness of the Cu-added steel sheet may be guessed. However, it is difficult to observe fine precipitates of single nano-order like the Cu-clusters in the related art; and therefore, the relationship with the toughness is not clear, and a method of controlling a fine precipitation process is also not clear. The present inventors considered these, and findings that are obtained by the examination are as follows.

<1> The toughness of the obtained hot-rolled steel sheets varies within a range of 10 J/cm$^2$ to 100 J/cm$^2$ according to production conditions.

<2> The metal structure of the obtained hot-rolled steel sheets was observed by an optical microscope. From the observation, non-recrystallization structure of ferrite was found in all of the hot-rolled steel sheets. In addition, Cu precipitates were not found even when performing examination using any method of a scanning electron microscope (SEM) and a transmission electron microscope (TEM). That is, even when the generation of the Cu precipitates is sufficiently suppressed, it can be seen that both of steels having satisfactory toughness and steels having poor toughness are present.

Therefore, examination was performed using a three-dimensional atom probe to examine a relatively fine state. From the examination, in a hot-rolled steel sheet having toughness of less than 20 J/cm$^2$, a plurality of fine clusters (Cu clusters) consisting of Cu were observed. On the other hand, in a hot-rolled steel sheet having toughness of 20 J/cm$^2$ or more, the fine Cu clusters were not recognized, or the density thereof was very low.

Commonly, the Cu precipitates are recognized as precipitates in which Cu atoms gather to form a crystal structure such as BCC, 9R, or FCC. In addition, the precipitates that are confirmed by the TEM observation in the related art have sizes of several tens of nanometers or more.

Meanwhile, in the present invention, the "Cu-rich cluster (Cu cluster)" is defined as an assembly of Cu atoms which has a maximum diameter of 5 nm or less, and the assembly of Cu atoms is confirmed by the examination of the three-dimensional atom probe. In addition, the crystal structure of the Cu clusters defined in the present invention is not particularly limited, and the Cu clusters include precipitates having a crystal structure such as BCC, 9R or the like, or a structure in which a precursory state of a precipitate if it is present. On the other hand, the present inventors have found that the toughness of the hot-rolled steel sheet has a close relationship with a density of the "Cu clusters" defined as described above.

<3> FIG. 9 is a graph showing a relationship between a coiling temperature of 1.2% Cu-added steels, a time taken until 1.2% Cu-added steel is immersed in a water bath after the coiling, and toughness. Meanwhile, symbols in the graph are as follows. ○: Charpy impact value ≥20 J/cm$^2$, and x: Charpy impact value <20 J/cm$^2$.

As is clear from the graph of FIG. 9, in the case where a coiling temperature is in a range of 500° C. or lower, the longer the time taken until the 1.2% Cu-added steel is immersed in the water bath is, the further Charpy impact value (toughness value) decreases. In addition, when a certain time is elapsed, the toughness value becomes in a range of lower than 20 J/cm$^2$.

In addition, even when conditions of the coiling temperature and the conditions of the time taken until being immersed in the water bath are the same, it becomes clear that the toughness becomes low in the case where a time (immersion time) that the 1.2% Cu-added steel is immersed in the water bath is shorter than 1 hour. That is, the present inventors have found that the toughness of the hot-rolled steel sheet is affected by the coiling temperature, the time taken until the hot-rolled steel sheet is immersed in the water bath, and the immersion time, and satisfactory toughness can be obtained by controlling the factors.

The present invention has been made on the basis of the findings described above, and the features of the present invention to solve the above-described problems are as follows.

(1) There is provided a hot-rolled ferritic stainless steel sheet according to a first aspect of the invention which has a steel composition containing, in terms of % by mass: 0.02% or less of C; 0.02% or less of N; 0.1% to 1.5% of Si; 1.5% or less of Mn; 0.035% or less of P; 0.010% or less of S; 1.5% or less of Ni; 10% to 20% of Cr; 1.0% to 3.0% of Cu; 0.08% to 0.30% of Ti; and 0.3% or less of Al, with the balance being Fe and unavoidable impurities. The hot-rolled ferritic stainless steel sheet has a Vickers hardness of less than 235 Hv.

(2) The hot-rolled ferritic stainless steel sheet according to (1) may further contain one or more selected from a group consisting of, in terms of % by mass, 0.3% or less of Nb, 0.3% or less of Mo, 0.3% or less of Zr, 0.5% or less of Sn, 0.3% or less of V, and 0.0002% to 0.0030% of B.

(3) There is provided a method for producing a hot-rolled ferritic stainless steel sheet according to a first aspect of the present invention which includes: subjecting a slab, which is obtained by casting a ferritic stainless steel having a steel composition according to (1) or (2), to finish rolling of hot rolling so as to form a hot-rolled steel sheet; and subsequently coiling the hot-rolled steel sheet under a condition where a coiling temperature is set to be in a range of 620° C. to 750° C.

(4) In the method for producing a hot-rolled ferritic stainless steel sheet according to (3), after the coiling of the hot-rolled steel sheet according to (3), a hot-rolled coil is subjected to hot idling or cooling while controlling a temperature T (K) of the hot-rolled steel sheet and a holding time t (h) such that the following relation (Expression 1) is fulfilled with respect to the entirety of the hot-rolled coil.

$$T(20.24+\log(t))\geq 17963 \quad \text{(Expression 1)}$$

(5) There is provided a method for producing a hot-rolled ferritic stainless steel sheet according to a first aspect of the invention which includes: after subjecting a slab having a steel composition according to (1) or (2) to finish rolling of hot rolling, setting an average cooling rate between 850° C. and 450° C. to be in a range of 10° C./s or more; and coiling a hot-rolled ferritic stainless steel sheet under a condition where a coiling temperature is set to be in a range of 350° C. to 450° C.

(6) There is provided a method for producing a ferritic stainless steel sheet related to a first aspect of the invention which includes: subjecting the hot-rolled steel sheet produced by the method according to (3), (4), or (5) to hot-rolled sheet pickling, cold rolling, cold-rolled sheet annealing, and cold-rolled sheet pickling.

(7) There is provided a method for producing a ferritic stainless steel sheet according to a first aspect of the invention which includes subjecting the hot-rolled steel sheet produced by the method according to (3), (4), or (5) to hot-rolled sheet annealing, hot-rolled sheet pickling, cold rolling, cold-rolled sheet annealing, and cold-rolled sheet pickling.

(8) In the method for producing a ferritic stainless steel sheet according to (6) or (7), when performing the cold rolling, rolling work rolls having a roll diameter of 400 mm or more may be used.

(9) There is provided a hot-rolled ferritic stainless steel sheet according to a second aspect of the invention which has a steel composition containing, in terms of % by mass: 0.0010% to 0.010% of C; 0.01% to 1.0% of Si; 0.01% to 2.00% of Mn; less than 0.040% of P; 0.010% or less of S; 10.0% to 30.0% of Cr; 1.0% to 2.0% of Cu; 0.001% to 0.10% of Al; and 0.0030% to 0.0200% of N, with the balance being Fe and unavoidable impurities. In crystal grains, a number density of Cu clusters, which consist of Cu and have maximum diameters of 5 nm or less, is in a range of less than $2\times10^{13}$ counts/mm$^3$.

(10) The hot-rolled ferritic stainless steel sheet according to (9) may further contain one or more selected from a group consisting of, in terms of % by mass, 0.10% to 0.70% of Nb, and 0.05% to 0.30% of Ti in such a manner that the following relation (Expression 2) is fulfilled.

$$Nb/93+Ti/48\geq C/12+N/14 \quad \text{(Expression 2)}$$

(11) The hot-rolled ferritic stainless steel sheet according to (9) or (10) may further contain one or more selected from a group consisting of, in terms of % by mass, 0.1% to 1.0% of Mo, 0.1% to 1.0% of Ni, and 0.50% to 3.0% of Al.

(12) The hot-rolled ferritic stainless steel sheet according to any one of (9) to (11) may further contain, in terms of % by mass, 0.0001% to 0.0025% of B.

(13) There is provided a method which includes: a process of subjecting a slab, which is obtained by casting a ferritic stainless steel having a steel composition according to any one of (9) to (12) so as to form a hot-rolled steel sheet; a process of coiling the hot-rolled steel sheet into a coil shape under a condition where a coiling temperature T is set to be in a range of 300° C. to 500° C. after the hot rolling; and a process of immersing the hot-rolled steel sheet having a coil shape into a water bath for 1 hour or more, and taking out the hot-rolled steel sheet from the water bath after the immersing. After the process of coiling the hot-rolled steel sheet into the coil shape, the hot-rolled steel sheet is immersed in the water bath within a time tc (h) that fulfills the following relation (Expression 3).

$$tc=10^{\wedge}((452-T)/76.7) \quad \text{(Expression 3)}$$

Effects of the Invention

As described above, according to the present invention, in a Cu-added ferritic stainless steel excellent in heat resistance, the coiling temperature in the hot rolling is optimized to control morphology of Cu-based precipitates; and thereby, hardness is adjusted. Accordingly, deterioration in toughness that is a problem in the related art can be prevented.

In addition, the morphology of the Cu-based precipitates can be optimized by controlling the coiling temperature. Accordingly, after cold-rolled sheet annealing that is a subsequent process of the coiling, a texture in {222} plane direction which is advantageous for workability can be developed. As a result, workability of the steel sheet can be improved.

In addition, according to the present invention, fine Cu-clusters that have an effect on the toughness of the hot-rolled steel sheet are distributed at a low number density compared to the related art. Accordingly, a decrease in toughness of the hot-rolled steel sheet can be suppressed; and as a result, cold cracking of the hot-rolled steel sheet can be prevented.

In addition, according to the hot-rolled ferritic stainless steel sheet of the present invention, even when being subjected to continuous annealing or pickling process after the hot rolling, cold cracking does not occur.

In addition, according to the present invention, cold cracking of the hot-rolled ferritic stainless steel sheet containing Cu is suppressed; and thereby, a production yield ratio can be increased and production efficiency can be improved. As a result, from the viewpoint of reduction in the production cost, a very effective industrial effect can be exhibited. In addition, energy that is used can be reduced due to the improvement in production efficiency; and therefore, the present invention can contribute to global environment conservation.

Particularly, the hot-rolled ferritic stainless steel sheet according to the present invention is applied to exhaust system members of vehicles and the like; and thereby, a great effect may be obtained with regard to an environmental measure, a cost reduction of components, and the like.

BEST MODE FOR CARRYING OUT THE INVENTION

Figure 1:
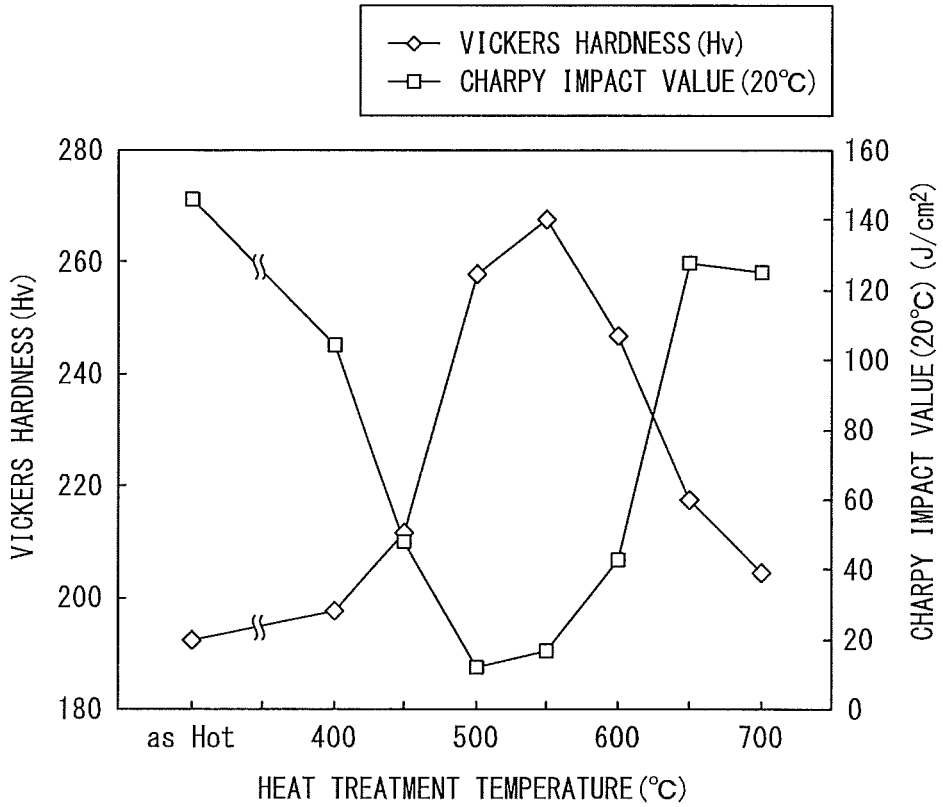
FIG. 1 is a graph showing an effect of a heat treatment temperature on Vickers hardness and absorption energy of a Charpy impact test at 20° C. of hot-rolled ferritic stainless steel sheet according to a first embodiment. In addition, the heat treatment temperature shown in FIG. 1 represents a temperature obtained by simulating a coiling temperature.

Hot-Rolled Ferritic Stainless Steel Sheet (First Embodiment)

Hereinafter, a hot-rolled ferritic stainless steel sheet of this embodiment will be described in detail.

The hot-rolled ferritic stainless steel sheet has a steel composition containing, in terms of % by mass, 0.02% or less of C, 0.02% or less of N, 0.1% to 1.5% of Si, 1.5% or less of Mn, 0.035% or less of P, 0.010% or less of S, 1.5% or less of Ni, 10% to 20% of Cr, 1.0% to 3.0% of Cu, 0.08% to 0.30% of Ti, and 0.3% or less of Al, with the balance being Fe and unavoidable impurities. The hot-rolled ferritic stainless steel sheet has a Vickers hardness of less than 235 Hv.

Hereinafter, the reason why the steel composition of the hot-rolled ferritic stainless steel sheet of this embodiment is limited will be described. In addition, description of % with respect to the composition represents % by mass unless otherwise stated.

C: 0.02% or less

C deteriorates formability, corrosion resistance, and toughness of a hot-rolled sheet. Therefore, the smaller the content of C is, the more preferable. Accordingly, the upper limit is set to 0.02%. However, excessive reduction leads to an increase in the refining cost. In addition, from the viewpoint of the corrosion resistance, the content of C is preferably set to be in a range of 0.001% to 0.009%.

N: 0.02% or less

Similarly to C, N deteriorates formability, corrosion resistance, and toughness of the hot-rolled sheet. Therefore, the smaller the content of N is, the more preferable. Accordingly, the content is set to be in a range of 0.02% or less. However, excessive reduction leads to an increase in the refining cost; and therefore, the content of N is preferably set to be in a range of 0.003% to 0.015%.

Si: 0.1% to 1.5%

Si is an element that is useful as a deoxidizing agent and improves high-temperature strength and oxidation resistance. High-temperature strength at a temperature of up to 800° C. is improved along with an increase in the content of Si, and the effect is exhibited at a content of 0.1% or more. Therefore, the lower limit is set to 0.1%. However, excessive addition decreases ductility at ordinary temperature; and therefore, the upper limit is set to 1.5%. In addition, when considering the oxidation resistance, the content of Si is preferably in a range of 0.2% to 1.0%.

Mn: 1.5% or less.

Mn is an element that is added as a deoxidizing agent and contributes to an increase in high-temperature strength in an intermediate temperature range. In addition, Mn is an element that forms Mn-based oxides in a surface layer during use for a long period of time; and thereby, Mn contributes to adhesiveness of scales (oxides) and an effect of suppressing abnormal oxidization.

On the other hand, when Mn is excessively added, a decrease in toughness of a hot-rolled sheet due to precipitation of γ-phase (austenite phase) is caused, and in addition to this, MnS is formed; and thereby, corrosion resistance is deteriorated. Therefore, the upper limit is set to 1.5%. In addition, when considering high-temperature ductility, adhesiveness of scales, and suppression of abnormal oxidation, the content of Mn is preferably in a range of 0.1% to 1.0%.

P: 0.035% or less

P is an element which has a high solid-solution strengthening ability. However, P is a ferrite stabilizing element, and P is a harmful element with respect to corrosion resistance or toughness. Therefore, it is preferable that the content of P be as low as possible.

P is contained in ferrochromium that is a raw material of a stainless steel as an impurity. However, it is very difficult to conduct dephosphorization of a molten steel of a stainless steel; and therefore, it is preferable to set the content of P to be in a range of 0.010% or more. In addition, the content, of P is mostly determined according to purity and an amount of a ferrochromium raw material that is used. However, P is a harmful element; and therefore, it is preferable that the purity of P of the ferrochromium raw material be low. However, low-P ferrochromium is expensive; and therefore, P is set to be in a range of 0.035% or less that is a range not greatly deteriorating the quality of a material or corrosion resistance. In addition, the content of P is preferably in a range of 0.030% or less.

S: 0.010% or less

S forms sulfide-based inclusions, and S deteriorates general corrosion resistance (entire surface corrosion or pitting corrosion) of a steel material. Therefore, it is preferable that the upper limit of the content of S be small, and the upper limit is set to 0.010%. In addition, as the content of S is small, corrosion resistance becomes satisfactory, however, low sulfurization leads to an increase in desulfurization load, and the production cost increases. Therefore, it is preferable that the lower limit be set to 0.001%. In addition, the content of S is preferably in a range of 0.001% to 0.008%.

Ni: 1.5% or less

Ni is mixed in an alloy raw material of the ferritic stainless steel as an unavoidable impurity. Generally, Ni is contained at a content in a range of 0.03% to 0.10%. In addition, Ni is an element that is useful for suppression of progress of pitting corrosion. In addition, when being added at a content of 0.05% or more, the effect of Ni is stably exhibited. Therefore, the lower limit is preferably set to 0.01%.

On the other hand, addition in a large amount may cause material hardening due to solid-solution strengthening; and therefore, the upper limit of Ni is set to 1.5%. In addition, when considering the alloy cost, the content of Ni is preferably in a range of 0.05% to 1.0%.

Cr: 10% to 20%

Cr is an essential element to secure oxidation resistance and corrosion resistance in the invention. This effect is not exhibited in the case where the content of Cr is less than 10%. On the other hand, in the case where the content exceeds 20%, a decrease in workability or deterioration in toughness is caused; and therefore, the content of Cr is set to be in a range of 10% to 20%. In addition, when considering manufacturability or high-temperature ductility, the content of Cr is preferably in a range of 10% to 18%.

Cu: 1.0% to 3.0%

Cu is a necessary element to increase high-temperature strength that is required when a steel is used as a high-temperature environment member represented by a high-temperature vehicle exhaust system. Cu exhibits mainly precipitation strengthening ability in a temperature range of 500° C. to 750° C. In addition, Cu shows a function of increasing thermal fatigue characteristics by suppressing plastic deformation of a material due to solid-solution strengthening at a temperature higher than the above described range. This effect is a precipitation strengthening operation due to generation of Cu precipitates, and the effect is exhibited by addition of 1.0% or more Cu. On the other hand, addition of an excessive amount causes a decrease in high-temperature strength; and therefore, the upper limit is set to 3.0%. In addition, when considering that Cu is solid-solubilized during cold-rolling annealing so as to suppress a decrease in workability, the content of Cu is preferably in a range of 1.0% to 1.5%.

Ti: 0.08% to 0.30%

Ti is an element that bonds with C, N, and S so as to improve corrosion resistance, grain-boundary corrosion resistance, ordinary-temperature ductility, and deep drawability. The content of Ti is determined by an amount of C, N, and S that may be economically reduced; and therefore, the lower limit of Ti is set to 0.08%. However, in the case where an excessive amount of Ti is added, an amount of surface defects in a slab increases due to TiN that crystalizes in a molten steel during continuous casting; and therefore, the upper limit is set to 0.30%. In addition, since an effect of improving corrosion resistance by solid-solubilized Ti, or toughness of a hot-rolled sheet or press workability by large-scaled precipitates of TiN may be decreased, the content of Ti is preferably set to be in a range of 0.10% to 0.18%.

Al: 0.3% or less

Al is added as a deoxidizing element. In addition to this, Al is an element that improves oxidation resistance. In addition, Al is useful as a solid-solution strengthening element to improve strength in a temperature range of 600° C. to 700° C. This operation is stably exhibited at a content of 0.01% or more; and therefore, the lower limit is preferably set to 0.01%.

On the other hand, in the case where an excessive amount of Al is added, uniform elongation is greatly decreased due to hardening, and in addition to this, toughness is greatly decreased. Therefore, the upper limit is set to 0.3%. Furthermore, when considering occurrence of surface defects, weldability, and manufacturability, the content of Al is preferably in a range of 0.01% to 0.07%.

In addition, in this embodiment, in addition to the above-described elements, it is preferable to add one or more kinds selected from a group consisting of 0.3% or less of V, 0.0002% to 0.0030% of B, 0.3% or less of Nb, 0.3% or less of Mo, 0.3% or less of Zr, and 0.5% or less of Sn.

V: 0.3% or less

V forms fine carbonitrides; and thereby, a precipitation strengthening operation occurs. Accordingly, V has an effect of contributing to improvement in high-temperature strength; and therefore, V is added as necessary. In the case where 0.03% or more of V is added, the effect is stably exhibited; and therefore, the lower limit is preferably set to 0.03%.

On the other hand, in the case where an excessive amount is added, coarsening of precipitates may be caused; and as a result, the toughness of the hot-rolled sheet decreases. Therefore, the upper limit is set to 0.3%. In addition, when considering the production cost or manufacturability, the content of V is preferably set to be in a range of 0.03% to 0.1%.

B: 0.0002% to 0.0030%

B is an element that improves secondary workability during press working of a product, and B also has an effect of improving high-temperature strength of a Cu-added steel. Accordingly, B is added as necessary. The effect is exhibited at a content of 0.0002% or more. However, addition of an excessive amount may deteriorate weldability in some cases in addition to deterioration in toughness or corrosion resistance due to precipitation of $Cr_2B$, $(Cr, Fe)_{23}(C, B)_6$; and therefore, the content of B is set to be in a range of 0.0002% to 0.0030%. In addition, when considering workability or the production cost, the content is preferably set to be in a range of 0.0003% to 0.0015%.

Nb improves high-temperature strength or thermal fatigue characteristics; and therefore, Nb may be added as necessary. The lower limit is preferably set to 0.01% in order for the effect to be exhibited.

On the other hand, addition of an excessive amount causes a Laves phase to be generated; and as a result, precipitation strengthening ability due to Cu precipitation is suppressed. Therefore, addition of an excessive amount is not preferable. In addition, in the case where high-temperature coiling at a temperature of 630° C. or higher is performed during hot rolling, there is a concern that toughness of a hot-rolled sheet may be decreased due to the Laves phase. In consideration of these, the upper limit of Nb is set to 0.3%. Furthermore, from the viewpoints of productivity or manufacturability, the content of Nb is preferably set to be in a range of 0.01% to 0.2%.

Mo improves high-temperature strength or thermal fatigue characteristics; and therefore, Mo may be added as necessary. The lower limit is preferably set to 0.01% in order for the effect to be exhibited.

On the other hand, similarly to Nb, addition of an excessive amount causes a Laves phase to be generated; and as a result, precipitation strengthening ability due to Cu precipitation is suppressed. Therefore, addition of an excessive amount is not preferable. In addition, in the case where high-temperature coiling at a temperature of 630° C. or higher is performed during hot rolling, there is a concern that toughness of a hot-rolled sheet may be decreased due to the Laves phase. In consideration of these, the upper limit of Mo is set to 0.3%. Furthermore, from the viewpoints of productivity or manufacturability, the content of Mo is preferably set to be in a range of 0.01% to 0.2%.

Similarly to Ti or Nb, Zr is an element that forms carbonitrides, and Zr contributes to improvement in oxidation resistance and improvement in high-temperature strength due to an increase in an amount of solid-solubilized Ti and Nb; and therefore, Zr may be added as necessary. The effect is stably exhibited by addition of 0.05% or more of Zr; and therefore, the lower limit is preferably set to 0.1%.

However, addition of an excessive amount may greatly cause deterioration in manufacturability; and therefore, the upper limit is set to 0.3%. In addition, when considering a cost or surface quality, the content of Zr is more preferably in a range of 0.1% to 0.2%.

Similarly to Mo, Sn is an element that is effective for improvement in corrosion resistance or high-temperature strength. In addition, Sn also has an effect not greatly deteriorating ordinary-temperature mechanical characteristics; and therefore, Sn may be added as necessary. Contribution to high-temperature strength is stably exhibited at a content of 0.05% or more; and therefore, the lower limit is preferably set to 0.05%.

On the other hand, when an excessive amount of Sn is added, manufacturability or weldability greatly deteriorates; and therefore, the upper limit is set to 0.5%. In addition, when considering oxidation resistance and the like, the content of Sn is preferably in a range of 0.1% to 0.3%.

Method for Producing Hot-Rolled Ferritic Stainless Steel Sheet

First Embodiment

Next, a method for producing a hot-rolled ferritic stainless steel sheet according to this embodiment will be described.

The method for producing a hot-rolled ferritic stainless steel sheet of the first embodiment includes: making a ferritic stainless steel having the above-described steel composition; subjecting a slab, which is obtained by casting after the steelmaking, to finish rolling of hot rolling so as to form a hot-rolled steel sheet; and subsequently coiling the hot-rolled steel sheet at a coiling temperature of 620° C. to 750° C.

In this embodiment, the steel containing the above-described essential components and components added as necessary is melted, and a slab is formed according to a known casting method (continuous casting). Next, the slab is heated to a predetermined temperature, and then the slab is hot-rolled to have a predetermined sheet thickness; and whereby, the slab is shaped into a hot-rolled steel sheet (hot-rolled sheet). In addition, a finish rolling termination temperature (finish temperature) of the hot rolling is set to be in a range of 800° C. to 980° C.

Next, after the finish rolling, the hot-rolled steel sheet is cooled and is coiled into a coil shape; and whereby, a hot-rolled coil is obtained.

Here, a temperature (coiling temperature) at which the hot-rolled steel sheet is coiled into a coil shape after the finish rolling has a great effect on the toughness of the hot-rolled sheet.

Hereinafter, the reason why the coiling temperature is limited in this embodiment will be described.

In this embodiment, the coiling temperature is set to be in a range of 620° C. to 750° C.

In the case where the coiling is performed within this coiling temperature range, Cu can be allowed to precipitate as ϵ-Cu; and therefore, hardness of the hot-rolled steel sheet after the coiling can be set to be in a range of less than 235 Hv.

As described above, the precipitated ϵ-Cu is not basically harmless to the toughness of the hot-rolled sheet. In addition, it is considered that Cu-rich clusters are formed during a process in which the Cu-based precipitates become the ϵ-Cu. However, in the case where hot idling is performed for a predetermined time depending on the coiling temperature after the coiling, a considerable amount of the solid-solubilized Cu can be allowed to precipitate as the ϵ-Cu. As a result, toughness allowing a hot-rolled sheet to pass through subsequent processes at an ordinary temperature (cold state) can be obtained. Meanwhile, after the hot-rolled steel sheet is coiled into a hot-rolled coil, hot idling time of the hot-rolled coil is referred to as a holding time t.

In addition, in the case where the coiling is performed within this coiling temperature range, an amount of Cu that precipitates during a temperature-raising step of cold-rolled sheet annealing that is a subsequent process is small, and a recrystallization texture having {222} plane direction is developed well; and as a result, a cold-rolled steel sheet having excellent workability can be produced.

However, in the case where the coiling is performed at a temperature of lower than 620° C., a reduction amount in temperature (temperature drop) at the top portion or the bottom portion of the hot-rolled coil after the coiling increases; and therefore, there is a concern that the holding time t may not be sufficiently secured. In addition, as described above, in the case where the holding time t is not secured, the ϵ-Cu may not be allowed to sufficiently precipitate. As a result, the toughness of the respective portions of the top portion and the bottom portion of the hot-rolled coil decreases; and thereby, there is a concern that a difference in the toughness may occur in the respective portions in the hot-rolled coil.

In addition, in the case where the coiling is performed at a temperature of higher than 750° C., oxidation of the hot-rolled coil progresses. Accordingly, there is a problem in that in a subsequent pickling after the coiling, a long period of time is necessary to remove oxidized scales on a surface of the hot-rolled sheet. Therefore, in this embodiment, the coiling temperature is set to be in a range of 620° C. to 750° C.

In addition, in this embodiment, after the hot-rolled steel sheet is coiled into a hot-rolled coil, it is preferable that hot idling or cooling of the resultant hot-rolled coil be performed while controlling a temperature T (K) and a holding time t (h) of the hot-rolled steel sheet in such a manner that the following Expression (1) is fulfilled with respect to the entire length of the hot-rolled coil. As described above, in the case where a temperature hysteresis over the entire length of the hot-rolled coil is controlled in such a manner that the following Expression (1) is fulfilled, a variation in toughness in the respective portions in the hot-rolled coil can be prevented; and thereby, satisfactory toughness of the hot-rolled sheet can be obtained.

$$T(20.24+\log(t))\geq 17963 \quad (1)$$

Hereinafter, Expression (1) will be described. Meanwhile, T (20.24+log(t)) in Expression (1) is referred to as an L value.

Generally, in a cooling process after the hot-rolled steel sheet is coiled into a hot-rolled coil, a cooling rate at the top portion or the bottom portion of the hot-rolled coil becomes high. Therefore, the temperature drop at the top portion and the bottom portion in the hot-rolled coil is larger than that at the middle portion, and the toughness of the top portion and the bottom portion deteriorates. As a result, there is a concern that a variation in toughness of the respective portion in the hot-rolled coil may occur. Furthermore, in the case where the coiling temperature becomes a low temperature, there is a concern related to the temperature drop of the top portion and the bottom portion in the hot-rolled coil. However, since this temperature drop varies depending on a hot-rolling coiler that is used, a cooling method of the hot-rolled coil after coiling, or the like, it cannot be said that this temperature drop becomes problematic without reservation. However, in the case where the deterioration in the toughness due to the temperature drop becomes problematic in the hot-rolled coil, it is preferable that the L value be controlled in such a manner that the temperature hysteresis over the entire length of the hot-rolled coil fulfills Expression (1) in a temperature range of 620° C. to 750° C. That is, it is preferable to perform hot idling or cooling of the hot-rolled coil while controlling the temperature (hot-rolled steel sheet temperature T) at the respective portions of the hot-rolled coil after the coiling, and adjusting the holding time t under the hot-rolled steel sheet temperature T at the respective portions.

Here, a method of controlling the L value is not particularly limited, and this control may be performed by appropriately selecting methods or conditions that are generally used. For example, in the case where the hot-rolled steel sheet after the finish rolling is cooled by pouring water to the range of the coiling temperature, with respect to portions that become the top portion and the bottom portion of the hot-rolled coil, the cooling is controlled by appropriately adjusting the cooling conditions. According to this control, a temperature distribution of the hot-rolled steel sheet before coiling is adjusted in such a manner that a temperature of the portions that become the top portion and the bottom portion is higher than that of the portion that becomes the middle portion. Then, the hot-rolled steel sheet having this temperature distribution state is coiled into a hot-rolled coil. That is, even in the case where the temperature of the top portion or the bottom portion drops in a cooling process after forming the hot-rolled coil, the top portion or the bottom portion is controlled to be a temperature higher than that of the middle portion within the coiling temperature; and thereby, the holding time t can be secured. As a result, Expression (1) can be fulfilled over the entire length of the hot-rolled coil.

Examination results for illustrating in detail the reason why the coiling temperature and Expression (1) are limited are shown below. In addition, in the following method of evaluating the toughness of the hot-rolled sheet, the number of samples is set to three, and a Charpy impact test is performed at 20° C. to obtain absorption energy. Then, evaluation is performed using the minimum value of the obtained results.

In FIG. 1, the ferritic stainless steel according to this embodiment was hot-rolled to have a sheet thickness of 5 mm while a finish temperature was set to 850° C.; and whereby, a hot-rolled sheet was obtained. Next, the hot-rolled sheet was cooled with water cooling while an average cooling rate until a temperature became 400° C. was set to 100° C./s, and then the resultant hot-rolled sheet was cooled with air cooling.

Next, in order to examine an effect of the coiling temperature during coiling after hot rolling, a heat treatment for one hour at various temperatures was performed using the obtained hot-rolled sheet to reproduce a temperature hysteresis during the coiling.

Next, a Vickers hardness of the hot-rolled sheet (heat-treated sheet) after the heat treatment was measured, and three samples of Charpy impact test specimens (having a sub-size of a sheet thickness) having a sheet thickness were collected from the hot-rolled sheet, and a Charpy impact test was performed at 20° C. to evaluate the toughness of the hot-rolled sheet. In addition, the minimum value of absorption energy at various temperatures was shown in FIG. 1.

As is clear from FIG. 1, it can be understood that when a heat treatment temperature is in a range of higher than 450° C. to 600° C., the hardness of the hot-rolled sheet increases sharply to 235 Hv or more, and on the other hand, toughness greatly decreases. This is considered to be because Cu-rich clusters precipitate. However, when the heat treatment temperature is in a range of 620° C. or higher, it can be understood that the hardness becomes soft to a value of less than 235 Hv, and at the same time, the absorption energy increases sharply, and the toughness greatly increases.

In addition, a steel component of the ferritic stainless steel that is used to examine the relationship shown in FIG. 1 is 14% Cr-0.5% Si-0.5% Mn-0.005% C-0.010% N-0.15% Ti-1.2% Cu-0.0005% B.

Figure 2:
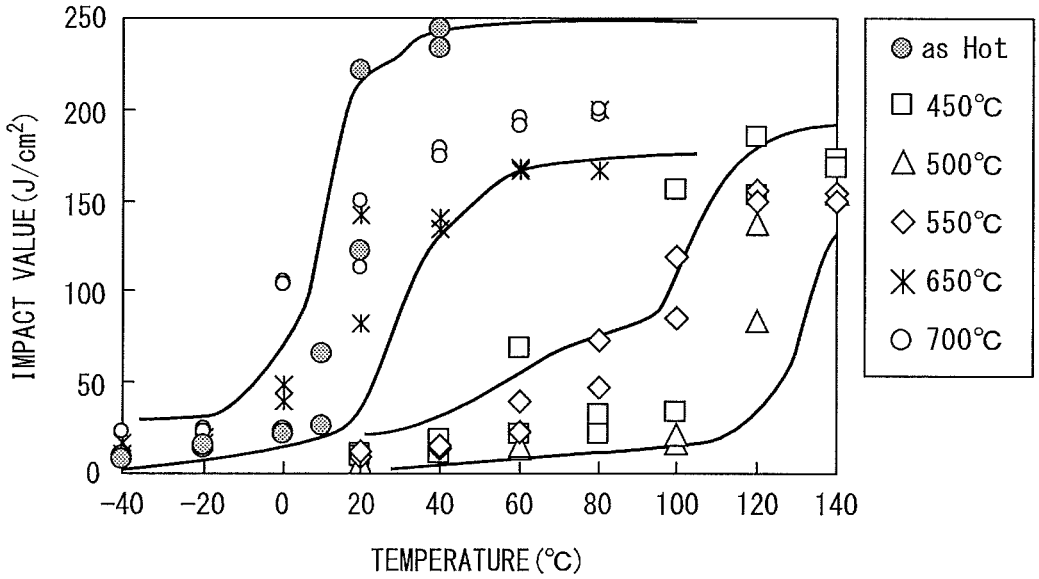
FIG. 2 is a graph showing an effect of a heat treatment temperature on a ductility-brittleness transition temperature of a Charpy impact test of the hot-rolled ferritic stainless steel sheet according to the first embodiment. In addition, the heat treatment temperature shown in FIG. 2 represents a temperature obtained by simulating the coiling temperature.

FIG. 2 shows results obtained by subjecting heat-treated sheets produced by the same method as the case of FIG. 1 to the Charpy impact test in a range of −40° C. to 140° C.

As is clear from FIG. 2, it can be understood that when being heat-treated at a temperature of 450° C. to 550° C., a transition temperature of ductility-brittleness is raised to a temperature near 100° C. On the other hand, when being heat-treated at 650° C. and 700° C., it can be understood that the transition temperature of ductility-brittleness becomes in a range of 20° C. or lower; and therefore, toughness equal to or larger than that of a hot-rolled sheet not being subjected to the heat treatment is exhibited.

In addition, a steel component of the ferritic stainless steel that is used to examine the relationship shown in FIG. 2 is 14% Cr-0.9% Si-0.5% Mn-0.005% C-0.010% N-0.15% Ti-1.5% Cu-0.0005% B.

Figure 3:
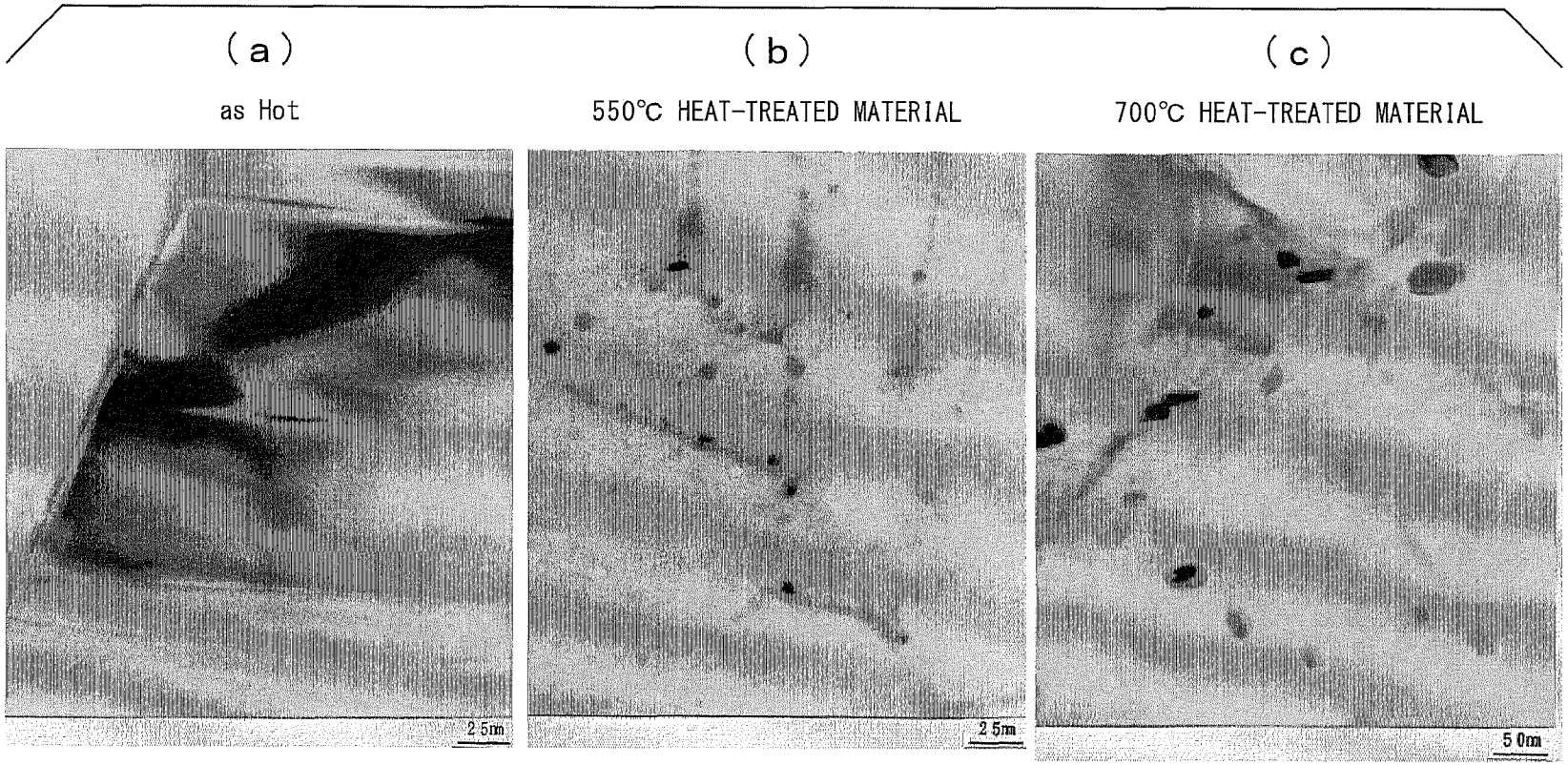
FIG. 3 is a diagram showing results obtained by observing a precipitation state of Cu-based precipitates using a transmission electron microscope after a heat treatment at various temperatures with regard to the hot-rolled ferritic stainless steel sheet according to the first embodiment.

Cu precipitates in the heat-treated materials as shown in FIG. 2 were observed with a transmission electron microscope so as to clarify the cause why the toughness of the hot-rolled sheet greatly varies as shown in FIG. 2 depending on the heat treatment temperature. In addition, the heat-treated materials that were observed are three kinds of a hot-rolled sheet (as Hot material) that was not subjected to the heat treatment, a material that was heat-treated at 550° C., and a material that was heat-treated at 700° C. Observation results are shown in FIGS. 3(*a*) to 3(*c*). FIG. 3(*a*) shows the as Hot material, FIG. 3(*b*) shows the 550° C. heat-treated material, and FIG. 3(*c*) shows the 700° C. heat-treated material, respectively.

As is clear from FIG. 3(*a*), in the hot-rolled sheet that was not subjected to the heat treatment, the Cu precipitates are not recognized. On the other hand, in the 550° C. heat-treated material as shown in FIG. 3(*b*), it can be confirmed that fine Cu having a size of several nanometers precipitates. The fine Cu is considered as a Cu-rich cluster, and it can be understood that the fine Cu has a relatively large size on a dislocation, and the fine Cu relatively finely precipitates at a location other than the dislocation. In addition, in the 700° C. heat-treated material as shown in FIG. 3(*c*), it is observed that ϵ-Cu precipitates, and the size of the ϵ-Cu that is observed is in a range of 30 nm to 100 nm.

In addition, the reason why the toughness decreases due to the Cu-rich clusters is not clear. However, from the fact that uniform elongation is approximately 10% when performing a tensile test, it may not be valid to consider that the brittle fracture is caused due to deficiency of ductility at an ordinary temperature. Instead of it, it is assumed as follows. The precipitates are very finely dispersed; and thereby, high-speed migration of the dislocation is inhibited. As a result, brittle fracture occurs.

Figure 4:
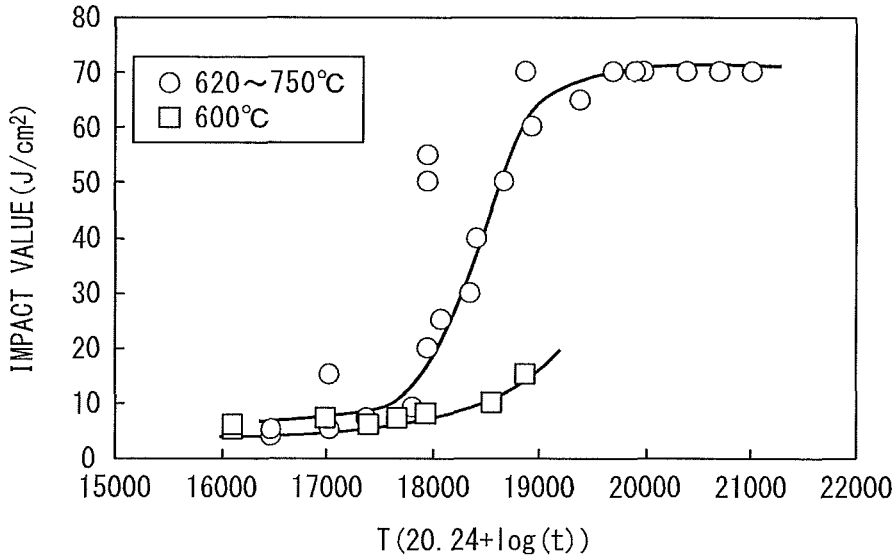
FIG. 4 is a graph showing an effect of an L value on an impact value of the Charpy impact test at 20° C. of the hot-rolled ferritic stainless steel sheet according to the first embodiment.

In FIG. 4, a hot-rolled sheet produced by the same manner as the case of FIG. 1 was rapidly heated to a temperature of 620° C. to 750° C. using a salt bath, and the sheet was subjected to a heat treatment for various times. Then, the sheet was cooled with water cooling. Next, the toughness of the hot-rolled sheet was examined. The heating temperature and the heat treatment time were arranged as the L value (T (20.24+log(t))) and are shown in FIG. 4. It can be understood that even when the heat treatment is performed at a temperature of 620° C. to 750° C., the toughness decreases in the case where a treatment time is short. From this result, in this embodiment, after the hot-rolled sheet is coiled, it is preferable that hot idling or cooling of the hot-rolled sheet be performed in such a manner that Expression (1) is fulfilled over the entire length of the coil.

In addition, a steel component of the ferritic stainless steel that is used to examine the relationship shown in FIG. 4 is 14% Cr-0.5% Si-0.3% Mn-0.005% C-0.010% N-0.15% Ti-1.2% Cu-0.0005% B.

Here, the reason why the temperature hysteresis of the hot-rolled coil after the coiling is defined by the L value in this embodiment will be described.

The precipitation of the ϵ-Cu in a steel sheet proceeds in a shorter time in a higher temperature range in the case where the temperature range is in the vicinity of the precipitation noze of Cu, or in a range of 620° C. to 750° C. In addition, a precipitation phenomenon is a diffusion-controlled phenomenon of atoms; and therefore, the precipitation phenomenon is arranged as a logarithmic product of a steel sheet temperature and a holding time. Therefore, test results in FIG. 4 are arranged as the L value, and it can be understood that satisfactory toughness of the hot-rolled sheet can be obtained under conditions in which the L value is in a range of 17,963 or more. From this, in this embodiment, the lower limit of the L value is set to 17,963. In addition, when considering the degree of difficulty of an operating control, the L value is more preferably set to be in a range of 18,240 or more.

Figure 5:
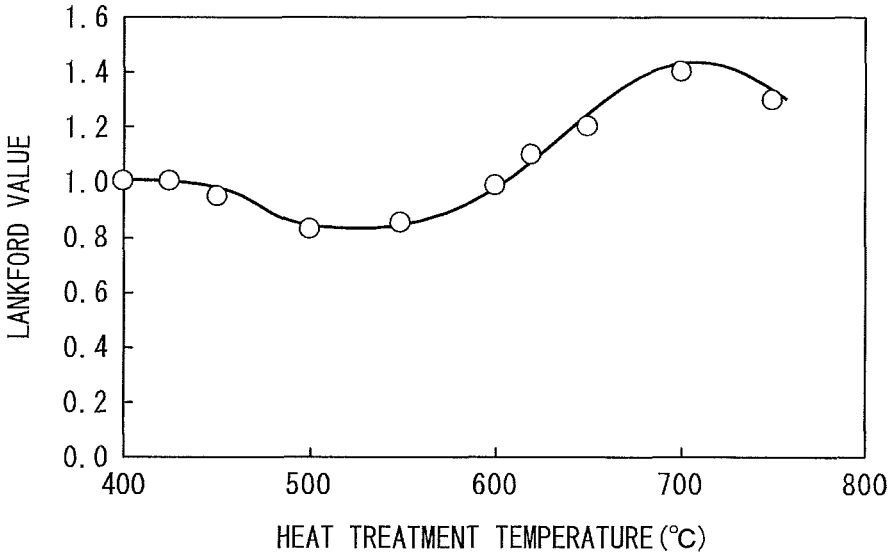
FIG. 5 is a graph showing an effect of the heat treatment temperature of the hot-rolled ferritic stainless steel sheet according to the first embodiment on a Lankford value of the cold-rolled annealed sheet. In addition, the heat treatment temperature shown in FIG. 5 represents a temperature obtained by simulating the coiling temperature.

In addition, in FIG. 5, a hot-rolled sheet produced by the same method as the case of FIG. 1 was heat-treated at a temperature of 400° C. to 750° C. for one hour and the sheet was cooled with air. Here, recrystallization annealing was omitted. The resultant sheet was cold-rolled from a sheet thickness of 5.0 mm to a sheet thickness of 2.0 mm, andthe sheet was subjected to cold-rolled sheet annealing in a range of 880° C. to 920° C. In addition, an average temperature rising rate in the cold-rolled sheet annealing was set to 4° C./s. A relationship between Lankford value (r value) measured using the obtained cold-rolled annealed sheet, and a temperature in a heat treatment performed with respect to the hot-rolled sheet is shown in FIG. 5. In addition, the heat treatment temperature is a temperature set to reproduce the coiling temperature in this embodiment.

As is clear form FIG. 5, it can be understood that the Lankford value increases in a temperature range of 620° C. to 750° C., and the Lankford value becomes the highest value at 700° C. That is, it can be understood that workability of the cold-rolled sheet is improved by setting the coiling temperature to be in a range of 620° C. to 750° C.

In addition, in the production of the hot-rolled ferritic stainless steel sheet of this embodiment, the hot-rolled sheet annealing, which is commonly performed after the hot rolling, may be performed. However, from the viewpoint of improvement in productivity, it is preferable not to perform the hot-rolled sheet annealing. With regard to a common Nb-added steel, a hot-rolled steel sheet is hard; and therefore, the hot-rolled sheet annealing is performed before cold rolling. However, in the steel sheet related to this embodiment, Nb is not added, or a small amount of Nb is added. Accordingly, the annealing of the hot-rolled steel sheet can be omitted; and therefore, the production cost can be reduced.

In addition, in the case where the annealing of the hot-rolled sheet is omitted, the ϵ-Cu which is allowed to precipitate during coiling can be maintained in a precipitated state during the cold rolling and in a temperature rising step during the cold-rolled sheet annealing. Accordingly, a texture after the cold rolling and the cold-rolled sheet annealing is developed; and thereby, press formability can be improved due to the improvement in the r value or reduction in anisotropy.

In addition, when performing the cold rolling that is a subsequent process of the method for producing the hot-rolled ferritic stainless steel sheet according to this embodiment, it is preferable to use rolling work rolls having a roll diameter of 400 mm or more.

Here, commonly, the cold rolling of the stainless steel sheet is either one of a reverse rolling by a Sendzimir mill having a work roll diameter (roll diameter) of approximately 60 mm to 100 mm, or a unidirectional rolling by a tandem type rolling mill having a work roll diameter of 400 mm or more. In addition, in both the cases, rolling is performed by a plurality of passes.

In this embodiment, it is preferable to perform the cold rolling using the tandem type rolling mill having a roll diameter of 400 mm or more so as to increase the r value that is an index of the workability. For example, in the case where a small-diameter roll having a roll diameter of 100 mm or less which is small is used, a large amount of shear strains are introduced to the vicinity of a surface layer of a steel sheet during cold rolling; and thereby, development of textures in {222} and {554} crystal directions is suppressed during the cold-rolled sheet annealing (recrystallization annealing) that is a subsequent process. As a result, it becomes difficult to improve the r value. However, in the case where the cold rolling is performed using a roll having a large diameter, the shear stains are suppressed; and thereby, the textures in the above-described crystal directions are greatly developed. Accordingly, the r value can be further improved. In addition, the tandem type rolling is a unidirectional rolling, and the number of rolling passes is smaller than that of the Sendzimir mill. Accordingly, the tandem type rolling is also excellent in productivity.

In addition, in the case where a rolling reduction is low in the cold rolling process, a recrystallized structure may not be obtained after the cold-rolled sheet annealing, or excessive coarsening occurs; and thereby, mechanical properties may be deteriorated. Therefore, the rolling reduction in the cold rolling process is preferably in a range of 50% or more.

In addition, in this embodiment, other production processes are not particularly specified. However, a sheet thickness of the hot-rolled sheet, a cold-rolled sheet annealing temperature, a cold-rolled sheet annealing atmosphere, and the like may be appropriately selected. In addition, as preferable conditions, the sheet thickness of the hot-rolled sheet is preferably set to be in a range of 3.0 mm to 5.0 mm, the cold-rolled sheet annealing temperature is preferably set to be in a range of 860° C. to 960° C., the cold-rolled sheet annealing atmosphere is preferably set to a combustion gas atmosphere or a mixed atmosphere of hydrogen and nitrogen. In addition, temper rolling or tension leveler may be applied after the cold rolling and the cold-rolled sheet annealing. Furthermore, a sheet thickness of products (cold-rolled steel sheets) may be selected according to a required member thickness.

In addition, in the invention, since Nb is not added or the content of Nb is small, a cold-rolled sheet annealing temperature after the cold rolling can be set to a low temperature in a range of 850° C. to 970° C. However, during cooling process, it is preferable to perform the cooling at a cooling rate of 10° C./s or more so as to prevent hardening due to precipitation of Cu-rich clusters.

As described above, according to the hot-rolled ferritic stainless steel sheet related to the invention, Cu precipitates as the ϵ-Cu; and therefore, hardness of the steel sheet can be set to be in a range of less than 235 Hv. As a result, toughness allowing a hot-rolled sheet to pass through subsequent processes at an ordinary temperature (cold state) can be obtained.

According to the method for producing the hot-rolled ferritic stainless steel sheet related to the invention, the coiling temperature in the hot rolling is optimized to control morphology of Cu-based precipitates; and thereby, hardness is adjusted. Accordingly, deterioration in toughness that is a problem in the related art can be prevented.

In addition, the temperature hysteresis of the entirety of the hot-rolled steel sheet after the coiling is controlled; and thereby, a variation in toughness in the coil after coiling the hot-rolled steel sheet can be suppressed. As a result, satisfactory toughness of the hot-rolled sheet can be secured.

In addition, the morphology of the Cu-based precipitates can be optimized by controlling the coiling temperature or the temperature hysteresis after the coiling. Accordingly, after cold-rolled sheet annealing that is a subsequent process of the coiling, a texture in {222} plane direction which is advantageous for workability can be developed. As a result, workability of the steel sheet can be improved.

In addition, in the hot-rolled ferritic stainless steel sheet related to the invention, an expensive alloy element such as Nb and Mo is substituted with Cu. Accordingly, when hot-rolled ferritic stainless steel sheet is applied to exhaust system members of vehicles, a great effect may be obtained with regard to an environmental measure, a cost reduction of components, and the like.

Method for Producing Hot-Rolled Ferritic Stainless Steel Sheet

Second Embodiment

Next, a method for producing a hot-rolled ferritic stainless steel sheet according to the second embodiment of the invention will be described.

In the method for producing a hot-rolled ferritic stainless steel sheet of this embodiment, a ferritic stainless steel having the above-described steel composition is made, a slab, which is obtained by casting after the steel-making, is subjected to finish rolling of hot rolling. Next, an average cooling rate between 850° C. and 450° C. is set to be in a range of 10° C./s or more, and coiling is performed under a condition where a coiling temperature is set to be in a range of 350° C. to 450° C.

In addition, the production method of this embodiment is different from the production method of the first embodiment in cooling conditions and a coiling temperature after finish rolling. However, even when any one of the production methods of two embodiments is adapted, the above-described effect can be obtained.

In this embodiment, from the steel containing the above-described essential components and components added as necessary, a slab is obtained according to a known casting method (continuous casting). The slab is heated to a predetermined temperature, and then the slab is subjected to hot rolling to have a predetermined sheet thickness; and whereby, the slab is shaped into a hot-rolled steel sheet (hot-rolled sheet). In addition, a finish rolling termination temperature (finish temperature) of the hot rolling is set to be in a range of 800° C. to 980° C.

Next, after the finish rolling, the hot-rolled steel sheet is cooled with water cooling, and the sheet is coiled into a coil shape.

Here, cooling conditions after the finish rolling and a temperature (coiling temperature) at which the hot-rolled steel sheet is coiled into a coil shape have a great effect on the toughness of the hot-rolled sheet.

Hereinafter, the reason why the cooling conditions and the coiling temperature are limited in this embodiment will be described.

First, the reason why the cooling conditions are limited will be described.

In this embodiment, after the finish rolling, an average cooling rate between 850° C. to 450° C. is set to be in a range of 10° C./s or more.

As described above, according to examination by the present inventors, in the case of a Cu-added ferritic stainless steel, they have found that in a temperature range after the finish rolling to 450° C. (particularly, 600° C. to 450° C.), nano-order Cu-rich clusters precipitate; and thereby, the toughness dramatically decreases. That is, the precipitation of the Cu-rich clusters can be prevented by raising a cooling rate in this temperature range. This effect is stably exhibited in the case where the average cooling rate is in a range of 10° C./s or more; and therefore, the average cooling rate between 850° C. to 450° C. after the finish rolling is set to be in a range of 10° C./s or more. In addition, when considering improvement in toughness, the average cooling rate is preferably set to be in a range of 20° C./s or more.

Next, the reason why the coiling temperature is limited will be described.

In this embodiment, the coiling temperature is set to be in a range of 350° C. to 450° C.

In the case where the coiling temperature is too low, solid-solubilized C and solid-solubilized N are not sufficiently fixed as carbonitrides of Ti, Nb, and the like. Thereby, development of a recrystallization texture of {222} plane is inhibited during cold-rolled sheet annealing. As a result, there is a concern that workability may be deteriorated. On the other hand, in the case where the coiling temperature is too high, the Cu-rich clusters precipitate; and thereby, there is a concern that the toughness of the hot-rolled sheet may decrease. Accordingly, in this embodiment, the coiling temperature is set to be in a range of 350° C. to 450° C. for compatibility between the workability and the improvement in the toughness of the hot-rolled sheet. In addition, when considering a variation in temperature at respective portions in the coil, the coiling temperature is preferably set to be in a range of 380° C. to 430° C. for improvement in toughness.

Hereinafter, Examination results for illustrating in detail the reason why the cooling conditions and the coiling temperature are limited are shown below. In addition, in the following method of evaluating the toughness of the hot-rolled sheet, similarly to the first embodiment, the number of samples is set to three, and a Charpy impact test is performed at 20° C. to obtain absorption energy. Then, evaluation is performed using the minimum value of the obtained results.

As described in the first embodiment, as is clear from FIG. 1, it can be understood that in the case where a heat treatment temperature is in a range of higher than 450° C. to 600° C., the hardness increases sharply, and on the other hand, the toughness greatly decreases. This is considered to be because Cu-rich clusters precipitate.

In addition, a steel component of the ferritic stainless steel that is used to examine the relationship shown in FIG. 1 is 14% Cr-0.5% Si-0.5% Mn-0.005% C-0.010% N-0.15% Ti-1.2% Cu-0.0005% B.

Figure 6:
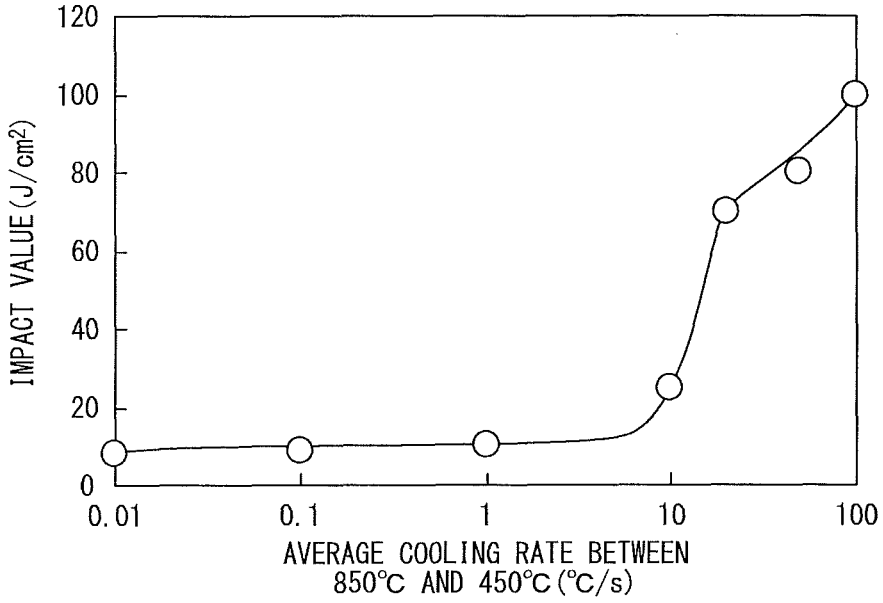
FIG. 6 is a graph showing an effect of an average cooling rate between 850° C. and 450° C. on the impact value of the Charpy impact test at 20° C. when a hot-rolled ferritic stainless steel sheet according to a second embodiment is coiled at 430° C.

Next, in FIG. 6, the ferritic stainless steel according to this embodiment was hot-rolled to have a sheet thickness of 5 mm under a condition where a finish temperature was set to 850° C. Then, the resultant hot-rolled steel sheet was cooled to 450° C. at a various average cooling rate by any one of furnace cooling, air cooling, air and water cooling, and water cooling. Then, the steel was coiled at 430° C. after the cooling; and whereby, a hot-rolled coil was obtained. Results obtained by evaluating the toughness of the hot-rolled sheet at 20° C. after the coiling are shown in FIG. 6.

As is clear from FIG. 6, an impact value increases along with an increase in average cooling rate. In addition, the impact value exceeds 20 J/cm$^2$ when the average cooling rate is 10° C./s or more. Accordingly, it is determined that the hot-rolled sheet can pass through the subsequent processes such as cold rolling at an ordinary temperature and a pickling treatment.

This is considered to be because in the case where the average cooling rate is less than 10° C./s, the Cu-rich clusters precipitated during a cooling process; and thereby, hardening occurs.

In addition, a steel component of the ferritic stainless steel that is used to examine the relationship shown in FIG. 6 is 17% Cr-0.1% Si-0.2% Mn-0.005% C-0.010% N-0.15% Ti-1.2% Cu-0.0005% B.

Figure 7:
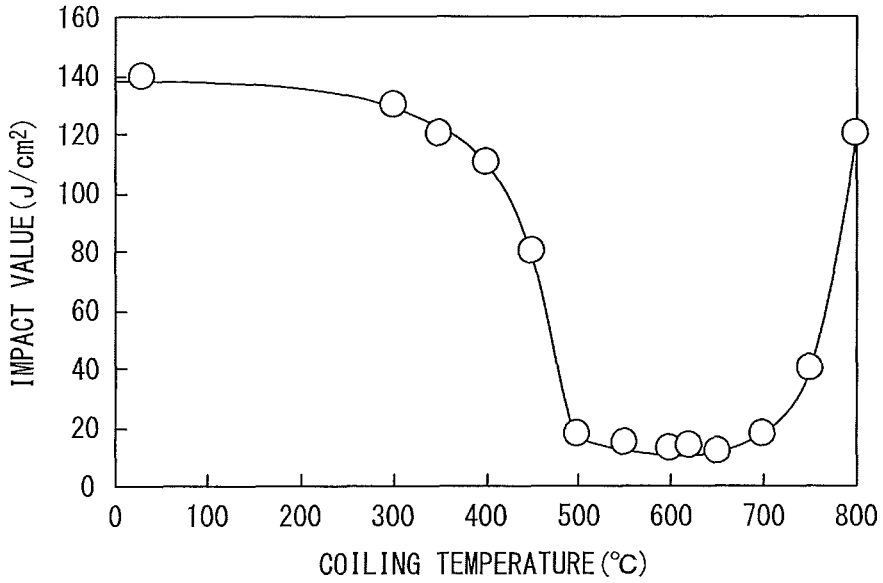
FIG. 7 is a graph showing a relationship between a coiling temperature and an impact value of the Charpy impact test at 20° C. of a bottom portion of a hot-rolled coil with regard to the hot-rolled ferritic stainless steel sheet according to the second embodiment.

In FIG. 7, the ferritic stainless steel according to this embodiment was hot-rolled to have a sheet thickness of 5 mm under a condition where the finish temperature was set to 850° C. Next, coiling was performed at a various coiling temperature from 30° C. to 800° C. Then, samples were collected from a bottom portion of the obtained hot-rolled coil to evaluate the toughness of the hot-rolled sheet, and evaluation results are shown in FIG. 7.

As is clear from FIG. 7, it can be understood that an impact value of the bottom portion is less than 20 J/cm$^2$ in the case where the coiling temperature is set to be in a range of 500° C. to 700° C.

Similarly to the graph shown in FIG. 1, this result is considered to be because in the case where the coiling temperature is set to be in a range of 500° C. to 700° C., the Cu-rich clusters precipitate at the bottom portion; and thereby, toughness decreases. In addition, even in this case, in the case where the coiling temperature is in a range of 620° C. to 750° C., it is possible to remove the variation in toughness in the respective portions in the hot-rolled coil by controlling a temperature hysteresis over the entire length of the hot-rolled coil to fulfill Expression (1).

In addition, a steel component of the ferritic stainless steel that is used to examine the relationship shown in FIG. 7 is 14% Cr-0.9% Si-0.5% Mn-0.005% C-0.010% N-0.15% Ti-1.2% Cu-0.0005% B.

Figure 8:
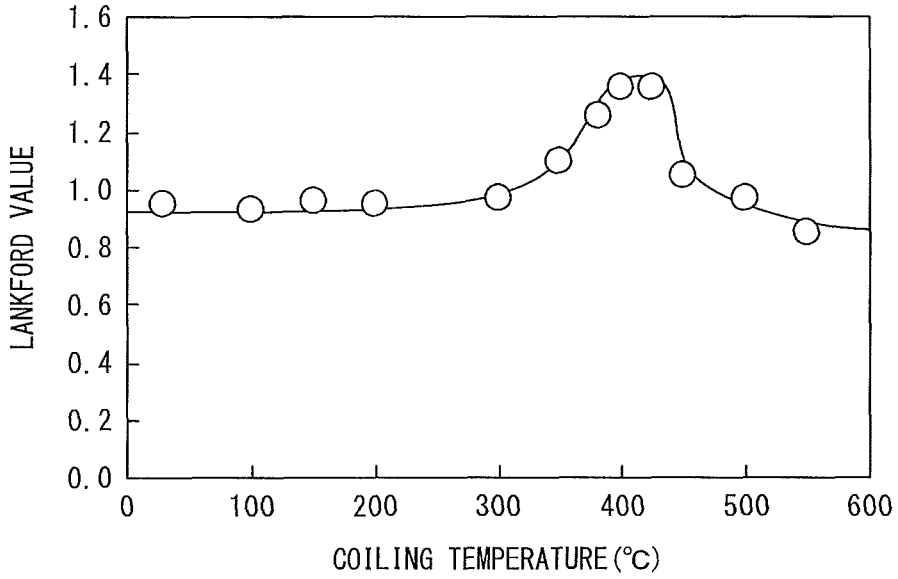
FIG. 8 is a graph showing an effect of the coiling temperature of the hot-rolled ferritic stainless steel sheet according to the second embodiment on the Lankford value after cold-rolled sheet annealing sheet.

In FIG. 8, the ferritic stainless steel according to this embodiment was hot-rolled to have a sheet thickness of 5 mm under a condition where the finish temperature was set to 830° C. Then, coiling was performed at a various coiling temperature from 30° C. to 550° C.

Next, the scale of the hot-rolled coil was removed by pickling, and then, the hot-rolled coil was rolled by cold rolling from a sheet thickness of 5 mm to a sheet thickness of 2 mm. Next, the sheet was subjected to cold-rolled sheet annealing at 900° C. In addition, an average temperature rising rate in the cold-rolled sheet annealing was set to 7° C./s. A relationship between a Lankford value measured using the obtained cold-rolled sheet and the coiling temperature is shown in FIG. 8.

As is clear from FIG. 8, the Lankford value shows the maximum value in the coiling temperature range of 350° C. to 450° C. That is, it can be seen that the workability of the cold-rolled sheet is improved by setting the coiling temperature to be in a range of 350° C. to 450° C. On the other hand, it is considered that a decrease in the Lankford value in the coiling temperature range of higher than 450° C. is caused by precipitation of the Cu-rich clusters. In addition, it is considered that a decrease in the Lankford value at a temperature of lower than 350° C. is caused by an increase in an amount of solid-solubilized C and solid-solubilized N.

In addition, a steel component of the ferritic stainless steel that is used to examine the relationship shown in FIG. 8 is 14% Cr-0.5% Si-0.5% Mn-0.005% C-0.010% N-0.15% Ti-1.2% Cu-0.0005% B.

Here, in this embodiment, the coiling temperature is specified in a range of 350° C. to 450° C. which is a low-temperature side range. In the case where the coiling temperature is on a low-temperature side in this manner, it is preferable that the average temperature rising rate in the cold-rolled sheet annealing be set to be in a range of 5° C./s or more. In the case where the temperature rising rate is too slow, the ε-Cu that is allowed to precipitate during coiling may grow to be Cu-rich clusters. Therefore, the average temperature rising rate in the cold-rolled sheet annealing is set to be in a range of 5° C./s or more; and thereby, generation of the Cu-rich clusters can be suppressed. As a result, a decrease in the r value can be further suppressed.

In addition, in the production of the ferritic stainless steel sheet of this embodiment, the hot-rolled sheet annealing, which is commonly performed after the hot rolling, may be performed. However, from the viewpoint of improvement in productivity, it is preferable not to perform the hot-rolled sheet annealing.

In a common Nb-added steel, a hot-rolled steel sheet is hard; and therefore, the hot-rolled sheet annealing is performed before cold rolling. However, in the steel sheet related to this embodiment, Nb is not added, or a small amount of Nb is added. Accordingly, the annealing of the hot-rolled steel sheet can be omitted; and therefore, the production cost can be reduced.

In addition, in the production of the ferritic stainless steel sheet of this embodiment, hot-rolled sheet annealing may be performed between the hot rolling and the hot-rolled sheet pickling. As described, in the production method according to this embodiment, the hot-rolled sheet annealing process can be omitted. However, in the case where the hot-rolled sheet annealing is conducted, it is preferable that a hot-rolled sheet annealing temperature be set to be in a range of 880° C. to 1,000° C. In this case, an atmosphere is preferably set to a combustion gas atmosphere. This preference is due to a production cost and productivity.

In addition, in the method for producing the ferritic stainless steel sheet of this embodiment, similarly to the first embodiment, when performing the cold rolling, it is preferable to use rolling work rolls having a roll diameter of 400 mm or more. In addition, it is preferable to perform the cold rolling using the tandem type rolling mill having a roll diameter of 400 mm or more so as to increase the r value that is an index of the workability.

In addition, in the case where a rolling reduction is low in the cold rolling process, a recrystallized structure may not be obtained after the cold-rolled sheet annealing, or excessive coarsening occurs; and thereby, mechanical properties may be deteriorated. Therefore, the rolling reduction in the cold rolling process is preferably in a range of 50% or more.

In addition, similarly to the first embodiment, even in this embodiment, other production processes are not particularly specified. However, a sheet thickness of the hot-rolled sheet, a cold-rolled sheet annealing temperature, a cold-rolled sheet annealing atmosphere, and the like may be appropriately selected. In addition, as preferable conditions, the sheet thickness of the hot-rolled sheet is preferably set to be in a range of 3.0 mm to 5.0 mm, the cold-rolled sheet annealing temperature is preferably set to be in a range of 860° C. to 960° C., the cold-rolled sheet annealing atmosphere is preferably set to a combustion gas atmosphere or a mixed atmosphere of hydrogen and nitrogen. However, in the cooling process after the cold-rolled sheet annealing, it is preferable that the cooling be performed at a cooling rate higher than that of air cooling so as to prevent hardening due to precipitation of the Cu-rich clusters.

In addition, temper rolling or tension leveler may be applied after the cold rolling and the cold-rolled sheet annealing. Furthermore, a sheet thickness of products may be selected according to a required member thickness.

According to the method for producing the ferritic stainless steel sheet related to the invention, the coiling temperature in the hot rolling is optimized to control morphology of Cu-based precipitates. Thereby, deterioration in toughness that is a problem in the related art can be prevented. In addition, an amount of solid-solubilized C or an amount of solid-solubilized N can be controlled; and thereby, workability can be improved.

In addition, Cu can be solid-solubilized by optimizing the coiling temperature and controlling the average cooling rate after the hot rolling. As a result, satisfactory toughness can be secured.

In addition, in the ferritic stainless steel sheet related to the invention, an expensive alloy element such as Nb and Mo is substituted with Cu. Accordingly, when hot-rolled ferritic stainless steel sheet is applied to exhaust system members of vehicles, a great effect can be obtained with regard to an environmental measure, a cost reduction of components, and the like.

Hot-Rolled Ferritic Stainless Steel Sheet (Second Embodiment)

Hereinafter, a hot-rolled ferritic stainless steel sheet of this embodiment will be described in detail.

The hot-rolled ferritic stainless steel sheet of this embodiment has a steel composition containing, in terms of % by mass, 0.0010% to 0.010% of C, 0.01% to 1.0% of Si, 0.01% to 2.00% of Mn, less than 0.040% of P, 0.010% or less of S, 10.0% to 30.0% of Cr, 1.0% to 2.0% of Cu, 0.001% to 0.10% of Al, and 0.0030% to 0.0200% of N, the balance being Fe and unavoidable impurities. In crystal grains, a number density of Cu clusters which consist of Cu and have the maximum diameters of 5 nm or less is in a range of less than $2\times10^{13}$ counts/$mm^3$.

Hereinafter, the reason why the steel composition of the hot-rolled steel sheet of this embodiment is limited will be described. In addition, description of % with respect to the composition represents % by mass unless otherwise stated.

C: 0.0010% to 0.010%

In the case where C is present in a solid-solution state, grain boundary corrosive properties of a welded portion deteriorate; and therefore, addition of a large amount is not preferable. Accordingly, the upper limit is set to 0.010%. In addition, when it is intended to reduce the content of C so as not to be affected by the grain boundary corrosive properties, an increase in production cost such as increase in a refining time is caused; and therefore, the lower limit is set to 0.0010%. In addition, from the viewpoints of the grain boundary corrosive properties of the welded portion and the production cost, the content of C is preferably set to be in a range of 0.0020% to 0.0070%.

Si: 0.01% to 1.0%

Si is an element that improves oxidation resistance. However, in the case where a large amount of Si is added, deterioration in toughness is caused; and therefore, the upper limit is set to 1.0%. On the other hand, since Si is unavoidably mixed in as a deoxidizing agent, the lower limit is set to 0.01%. In addition, the content of Si is preferably set to be in a range of 0.02% to 0.97%.

Mn: 0.01% to 2.00%

Mn is an element that improves high-temperature strength and oxidation resistance. However, in the case where a large amount of Mn is added, deterioration in toughness is caused as is the case with Si; and therefore, the upper limit is set to 2.00%. In addition, Mn may be unavoidably mixed in; and therefore, the lower limit is set to 0.01%. In addition, the content of Mn is preferably set to be in a range of 0.02% to 1.95%.

P: less than 0.040%

P is unavoidably mixed in from a raw material of Cr and the like; and therefore, 0.005% of P may be frequently mixed in. However, P decreases ductility or manufacturability; and therefore, it is preferable that the content of P be as low as possible. However, it is very difficult to conduct dephosphorization excessively, and production cost also increases; and therefore, the content of P is set to be in a range of less than 0.040%.

S: 0.010% or less

S forms a compound that is easy to dissolve, and S may deteriorate corrosion resistance. Therefore, it is preferable that the content of S be as low as possible, and the content of S is set to be in a range of 0.010% or less. In addition, from the viewpoint of corrosion resistance, it is preferable that the content of S be as low as possible. The content is preferably set to be in a range of less than 0.0050%.

In addition, in recent years, a desulfurization technology has been developed; and therefore, the lower limit of S is preferably set to 0.0001%. In addition, when considering stable manufacturability, the lower limit is more preferably set to 0.0005%.

Cr: 10.0% to 30.0%

Cr is a basic element that is necessary to secure corrosion resistance, high-temperature strength, and oxidation resistance, and it is necessary to add 10.0% or more of Cr in order for this effect to be exhibited. On the other hand, deterioration of toughness is caused due to addition of a large amount; and therefore, the upper limit is set to 30.0%. In addition, the more the content of Cr is, the further the strength increases, and an embrittlement peculiar to a high-Cr steel, which is called "475° C. embrittlement", has a tendency to occur. Therefore, the content of Cr is preferably set to be in a range of 20.0% or less.

Cu: 1.0% to 2.0%

Strength at high temperature increases by adding an appropriate amount of Cu; and therefore, it is appropriate to add Cu to a steel sheet for members of a vehicle exhaust system. In the case where an added amount is less than 1.0%, an amount of strengthening due to Cu is not sufficiently obtained. Therefore, the lower limit is set to 1.0%, and preferably in a range of 1.05% or more. On the other hand, addition of a large amount causes deterioration of toughness during production and in a cold-rolled product; and therefore, the upper limit is set to 2.0%, and preferably in a range of 1.75% or less.

Al: 0.001% to 0.10%

An appropriate amount of Al is added so that Al is utilized as a deoxidizing element. In the case where the content is less than 0.001%, deoxidizing performance becomes insufficient; and therefore, the lower limit is set to 0.001%. On the other hand, in the case where the added amount is 0.10%, an amount of oxygen can be sufficiently reduced, and deoxidizing performance is saturated at an added amount exceeding 0.10%. Furthermore, there is a concern that addition of an excessive amount may cause a decrease in workability; and therefore, the upper limit is set to 0.10%. In addition, the content of Al is preferably in a range of 0.002% to 0.095%.

N: 0.0030% to 0.0200%

As is the case with C, when N is present in a solid-solution state, grain boundary corrosive properties of a welded portion deteriorate; and therefore, addition of a large amount is not preferable. Therefore, the upper limit is set to 0.0200%. In addition, in order to reduce the content of N, an increase in production cost such as increase in a refining time is caused; and therefore, the lower limit is set to 0.0030%. In addition, from the viewpoints of the grain boundary corrosive properties of the welded portion and the production cost, the content of N is preferably set to be in a range of 0.0050% to 0.0120%.

In addition, in this embodiment, in addition to the above-described elements, it is preferable to add one or more selected from a group consisting of 0.10% to 0.70% of Nb and 0.05% to 0.30% of Ti in such a manner that the following Expression (2) is fulfilled.

$$Nb/93+Ti/48 \geq C/12+N/14 \quad (2)$$

Nb and Ti form precipitates in combination with C or N; and thereby, Nb and Ti have an operation of reducing an amount of solid-solubilized C and solid-solubilized N. Furthermore, in the case where Nb and Ti are present in a solid-solution state, high-temperature strength and thermal fatigue characteristics of members are improved due to solid-solution strengthening at a high temperature. It is necessary to add 0.10% or more of Nb or 0.05% or more of Ti so as to fix C and N; and therefore, these values are set as the lower limit, respectively. In addition, it is necessary to stoichiometrically fulfill the above-described Expression (2) in order for all of C and N present in a steel to be in a precipitation state.

On the other hand, in the case where large amounts of Nb and Ti are added, deterioration of toughness is caused during production, and occurrence of surface defects may be notable. Therefore, the upper limit of Nb is set to 0.70%, and the upper limit of Ti is set to 0.30%.

In addition, in this embodiment, in addition to the above-described elements, it is preferable to add one or more selected from a group consisting of 0.1% to 1.0% of Mo, 0.1% to 1.0% of Ni, and 0.50% to 3.0% of Al.

Mo, Ni, and Al are elements that increase high-temperature strength; and therefore, Mo, Ni, and Al may be added as necessary. Al is added for a purpose different from the above-described deoxidation; and therefore, an appropriate added amount is different. In addition, Ni also has an effect of improving toughness. In the case where the added amount of Mo is 0.10% or more, and the added amount of Ni is 0.10% or more, or the added amount of Al is 0.50% or more, an increase in high-temperature strength becomes notable. Accordingly, these values are set as the lower limits. In addition, addition of a large amount may cause deterioration of toughness during production and occurrence of surface defects; and therefore, the upper limits of Mo, Ni, and Al are set to 1.0%, 1.0%, and 3.0%, respectively.

In addition, in this embodiment, in addition to the above-described elements, it is preferable to add 0.0001% to 0.0025% of B.

B is an element that improves secondary workability. In the case where a steel is used in an intended use in which the secondary workability is required, B may be added as necessary. The effect of improving the secondary workability is exhibited in the case where the added amount is 0.0001% or more; and therefore, the lower limit is set to 0.0001%. In addition, addition of a large amount may decrease workability; and therefore, the upper limit is set to 0.0025%.

In addition, as an important characteristic of this embodiment, with regard to the size of Cu cluster consisting of Cu in crystal grains, the maximum diameter is set to be in a range of 5 nm or less. Meanwhile, the size of the Cu cluster is defined as the maximum diameter of the Cu cluster. Specifically, in the case where the Cu cluster has a spherical shape, the size is defined as a diameter, and in the case where the Cu cluster has a sheet shape, the size is defined as a diagonal length. In the invention, an average value of measured values of the maximum diameters is defined as the size. In addition, a method of measuring the maximum diameters of the Cu clusters will be described later.

According to the examination by the present inventors, they have found that in a sample in which the toughness of the hot-rolled steel sheet decreases, a large amount of Cu clusters having the maximum diameters of 5 nm or less are present. Accordingly, in the invention, in order to suppress a decrease in toughness of the hot-rolled steel sheet, the sizes (the maximum diameters) of the Cu clusters in crystal grains are set to be in a range of 5 nm or less.

In addition, in the invention, the lower limit of the size of the Cu cluster is not particularly limited. However, when considering measurement accuracy of the size of the Cu cluster, the maximum diameter is preferably set to be in a range of 1 nm or more.

In addition, as described above, the Cu clusters having the fine sizes are observed for the first time by a three-dimensional atom probe method or the like, and it is considered that the Cu clusters are present in a precursory state which are different from the Cu precipitates disclosed in the technology of the related art.

In addition, from the above-described examination, the present inventors also found that there is a relationship between the density of the Cu clusters having the fine size and the toughness of the hot-rolled steel sheet. Accordingly, in this embodiment, it is necessary to set a number density of the Cu clusters having the maximum diameters of 5 nm or less to be in a range of less than $2\times10^{13}$ counts/mm$^3$ so as to maintain the toughness in a satisfactory manner.

The number density of the Cu clusters has a great effect on the strength and the toughness of the hot-rolled steel sheet. In the case where Cu clusters are present at a number density of $2\times10^{13}$ counts/mm$^3$ or more, the toughness of the hot-rolled steel sheet greatly decreases, and cracking may frequently occur during cold rolling. It is considered that the Cu clusters having the maximum diameters of 5 nm or less serve as strong pinning sites such as dislocations and the like, the dislocations are piled up; and thereby, a stress tends to be focused. Therefore, it is considered that when a spatial density of the fine Cu clusters increases, a density of the stress focusing sites increases; and thereby, toughness decreases. Accordingly, the number density of the Cu clusters is set to be in a range of less than $2\times10^{13}$ counts/mm$^3$.

In addition, not only the above-described fine Cu clusters but also relatively large Cu precipitates have an effect on the toughness of the hot-rolled steel sheet. However, in a range of the disclosure of the invention, cooling is terminated before the coarse Cu precipitates appear; and therefore, coarse Cu precipitates are not observed. That is, it is considered that the toughness of the hot-rolled steel sheet in the invention is determined by the density of the Cu clusters having the maximum diameters of 5 nm or less.

Next, with regard to a method of measuring the sizes and the number density of the fine Cu clusters as described above, the Cu clusters are smaller than common precipitates; and therefore, it is difficult to measure the size or a distribution density by a transmission electron microscope (TEM).

Accordingly, in the invention, the sizes and the number density of the Cu clusters in crystal grains of the hot-rolled ferritic stainless steel sheet are measured using a three-dimensional atom probe (3D-AP) method described below in the following sequence.

First, a rod-shaped sample of 0.3 mm×0.3 mm×10 mm is cut from a hot-rolled steel sheet that is an object to be measured, and the sample is processed into a needle shape by an electrolytic grinding method. Measurement of 500,000 atoms or more is performed by the 3D-AP (manufactured by Oxford Nanoscience Co.) in an arbitrary direction in a crystal grain using the processed needle-shaped sample, visualization is performed by a three-dimensional map, and quantitative analysis is conducted.

The measurement in an arbitrary direction is performed with respect to 10 or more of different crystal grains, and average values of the number density (the number of clusters per volume of the observation region) and the sizes of the fine Cu clusters consisting of Cu contained in each crystal grain are obtained. Even in any shape such as a spherical shape and a sheet shape, the maximum length is measured as the size of the Cu cluster. Particularly, the shape of Cu clusters having a small size may not be clear in many cases. Therefore, it is preferable to perform precise size measurement using electrolytic evaporation of a field ion microscope (FIM).

Here, the FIM is a method in which a high voltage is applied to the needle-shaped sample, an inert gas is introduced, and an electric field distribution of a sample surface is two-dimensionally projected.

Generally, precipitates in a steel material give a bright or dark contrast compared to a ferrite matrix. Field evaporation of a specific atomic plane is performed for each atomic plane, and generation and extinction of the precipitate contrast is observed. Thereby, the size in a depth direction of the precipitates can be assumed with accuracy.

Method for Producing Hot-Rolled Ferritic Stainless Steel Sheet

Third Embodiment

Next, a method for producing a hot-rolled ferritic stainless steel sheet according to this embodiment will be described.

The method for producing a hot-rolled ferritic stainless steel sheet of this embodiment includes: a process of subjecting a slab obtained by casting a ferritic stainless steel having the composition disclosed in the hot-rolled ferritic stainless steel sheet (second embodiment) to hot rolling so as to form a hot-rolled steel sheet; a process of coiling the hot-rolled steel sheet into a coil shape under a condition where a coiling temperature T is set to be in a range of 300° C. to 500° C. after the hot rolling; and a process of immersing the hot-rolled steel sheet having a coil shape into a water bath for 1 hour or more, and taking out the hot-rolled steel sheet from the water bath after the immersion. After the process of coiling the hot-rolled steel sheet into a coil shape, the hot-rolled steel sheet is immersed in the water bath within a time tc (h) that fulfills the following Expression (3).

$$tc=10^{\wedge}((452-T)/76.7) \quad (3)$$

Hereinafter, the method for producing the hot-rolled ferritic stainless steel according to this embodiment will be described in detail.

First, hot rolling is performed using the slab obtained by casting the ferritic stainless steel having the steel composition. Next, after finish rolling is performed, the steel sheet is cooled with water cooling, and the steel sheet is coiled into a coil shape. In this embodiment, a coiling temperature T is set to be in a range of 300° C. to 500° C. In the case where the coiling temperature T is lower than 300° C., a cooled state before the coiling has a tendency to be non-uniform for each portion of the steel sheet. As a result, a defect of shape of a hot-rolled coil has a tendency to occur; and therefore, the temperature range is not preferable. In addition, in the case where the coiling temperature T is higher than 500° C., the number density of the above-described Cu clusters consisting of Cu greatly increases. Therefore, a defect in the toughness of the hot-rolled steel sheet may be caused; and therefore, this temperature range is not preferable.

Next, after the hot-rolled steel sheet is coiled into a coil shape, the hot-rolled steel sheet is subjected to an immersion treatment in a water bath. This treatment is performed so as to suppress the generation of the Cu clusters.

Here, the temperature of the hot-rolled steel sheet reaches the coiling temperature by the water cooling after the finish rolling, and then the Cu clusters having the maximum diameters of 5 nm or less are generated, the number density of the Cu clusters increases, and the toughness starts to decrease. An amount of time, from a point at which the temperature of the hot-rolled steel sheet reaches the coiling temperature to a point at which the toughness starts to decrease, strongly depends on a temporal change in the temperature of the hot-rolled steel sheet. In addition, in the case where the coiling is performed at a coiling temperature of 300° C. to 500° C. in common hot rolling, an amount of time from the end of the hot rolling to a point at which a temperature reaches the coiling temperature is in a range of 1 minute or shorter, and a cooling rate during this time is in a range of 3° C./s or more. Under this cooling rate condition, the Cu clusters do not precipitate before the coiling. In addition, this condition has no effect on the subsequent coiling conditions. That is, after a temperature reaches the coiling temperature and then the hot-rolled sheet is coiled into a coil shape, and before the toughness of the hot-rolled steel sheet decreases, it is necessary to quickly immerse the resultant hot-rolled coil in a water bath according to the coiling temperature so as to prevent the precipitation of the Cu clusters. Accordingly, an amount of time, which is taken after reaching the coiling temperature T and being coiled into a coil shape and until onset of immersion in a water bath, becomes important together with the above-described coiling temperature T.

From results of examination by the present inventors, in this embodiment, an amount of time t (h), which is taken after the hot rolling, the cooling, and the coiling at the coiling temperature T(° C.) and until the onset of the immersion, is set within tc of the above-described Expression (3).

In the case where the amount of time t, that is taken from a point at which a temperature reaches the coiling temperature T and until the onset of the immersion in a water bath, exceeds tc, the number density of the Cu clusters having sizes of 5 nm or less increases and exceeds $2\times10^{13}$ counts/mm$^3$. Thereby, the toughness of the steel sheet decreases; and therefore, the time range is not preferable. In addition, in the case where the coiling temperature T is high, a generation of the Cu clusters starts early; and therefore, tc is shortened. Conversely, in the case where the coiling temperature T is low, tc is lengthened.

In addition, in this embodiment, a holding time (immersion time) in the water bath after the immersion in the water bath is an important item. With regard to a steel sheet having a component system containing 1% or more of Cu which is a large amount, in the case where the immersion time in the water bath is less than one hour which is short, the cooling becomes insufficient. Thereby, suppression of the generation of the Cu clusters becomes insufficient. As a result, the toughness of the hot-rolled steel sheet may be poor; and therefore, the immersion time is set to be in a range of one hour or more. In addition, when considering improvement of the toughness, the immersion time is preferably set to be in a range of 1.2 hours or more. In addition, in this embodiment, the lower limit of the holding time in the water bath is not particularly limited. However, when considering productivity, the immersion time in the water bath is preferably set within 48 hours.

As described above, according to the hot-rolled ferritic stainless steel sheet related to this embodiment as described above, the number density of the fine Cu clusters having an effect on the toughness of the hot-rolled steel sheet has a distribution lower than that of the related art due to the above-described steel composition and configuration. Accordingly, a decrease in toughness of the hot-rolled steel sheet can be suppressed. As a result, cold cracking of the hot-rolled steel sheet can be prevented.

According to the hot-rolled ferritic stainless steel sheet related to this embodiment, even in the case where the steel sheet passes through a continuous annealing or pickling process after hot rolling, the cold cracking is not generated.

In addition, according to the hot-rolled ferritic stainless steel sheet related to this embodiment, the cold cracking can be suppressed; and therefore, an increase in production yield ratio, and improvement in production efficiency can be realized. As a result, from the viewpoint of reduction in the production cost, an industrially effective effect can be exhibited.

In addition, energy that is used in the production processes can be reduced due to the improvement in production efficiency; and therefore, the invention can contribute to global environment conservation.

In addition, according to the method for producing the hot-rolled ferritic stainless steel sheet related to this embodiment, since the coiling into a coil shape is performed at the above-described coiling temperature T, and a time tc, which is taken after the coiling and until onset of immersion in a water bath, and an immersion time are controlled; and thereby, the number density of the Cu clusters can be controlled. As a result, a decrease in toughness of the hot-rolled steel sheet can be suppressed.

According to this, a hot-rolled ferritic stainless steel sheet having excellent cold cracking properties can be provided.

EXAMPLES

Hereinafter, the effect of the invention will be described with reference to examples, but the invention is not limited to conditions that are used in the following examples.

Example 1

In this example, each steel having a component composition shown in Tables 1 and 2 was melted and was casted into a slab. The slab was heated to 1,190° C., and then the slab was hot-rolled to have a sheet thickness of 5 mm under a condition where a finish temperature was set to be in a range of 800° C. to 950° C.; and whereby, a hot-rolled steel sheet was formed.

Next, an average cooling rate was set to be in a range of 10° C./s to 100° C./s, and the hot-rolled steel sheet was cooled to respective coiling temperatures shown in Tables 3 and 4 by air cooling or water cooling according to the cooling rate. Then, coiling was performed at a predetermined coiling temperature shown in Tables 3 and 4; and whereby, a hot-rolled coil was obtained. In addition, a temperature of a hot-rolled steel sheet after the hot rolling was measured while monitoring the temperature by a radiation thermometer.

Subsequently, the hot-rolled coil was subjected to pickling to remove scales, and the sheet was subjected to cold rolling to have a sheet thickness of 2 mm; and whereby, a cold-rolled sheet was obtained. In addition, rolling work rolls as shown in Tables 3 and 4 were used during the cold rolling. Here, with respect to Test Nos. P58 to P63 in Tables 3 and 4, before performing the pickling, hot-rolled sheet annealing was performed under conditions where an annealing temperature was set to 950° C., an annealing time was set to 120 seconds, and an atmosphere was set to a combustion gas atmosphere.

After the cold rolling, the cold-rolled sheet annealing was performed in a combustion gas atmosphere, and then pickling was performed at a sheet passing speed with which a pickling time became 140 seconds; and whereby, a product sheet was obtained. In addition, an average temperature rising rate in the cold-rolled sheet annealing was set to 4° C./s.

In addition, in the cold rolling, either one of unidirectional multi-pass rolling using a rolling mill provided with large-diameter rolls (having a diameter of 400 mm), or reverse type multi-pass rolling using a rolling mill provided with small-diameter rolls (having a diameter of 100 mm) was performed.

In addition, a cold-rolled sheet annealing temperature was set to be in a range of 880° C. to 950° C. so as to realize a grain size number of approximately 6 to 8. In addition, in comparative examples in which the content of Nb deviated from the upper limit of the invention, the cold-rolled sheet annealing temperature was set to be in a range of 1,000° C. to 1,050° C.

Nos. 0A to 0C, and 1 to 24 in Table 1 represent invention examples, and Nos. 25 to 44 in Table 2 represent comparative examples.

Hardness of the hot-rolled coil obtained as described above was evaluated by a Vickers hardness test (according to JIS Z 2244), and hardness of less than 235 Hv was regarded as pass. In addition, the hardness test was performed by setting a test load to 5 kgf.

In addition, V-notched Charpy impact test specimens were made from the hot-rolled coil, and a Charpy test was performed at 20° C. to measure absorption energy. In addition, the Charpy test was performed according to JIS Z 2242, and evaluation was performed in such a manner that an impact value of 20 J/cm$^2$ or more was regarded as a pass (○) and an impact value of less than 20 J/cm$^2$ was regarded as failure (x). Results are shown in Tables 3 and 4.

In addition, the test specimens in this example were sub-sized test specimens having the sheet thickness of the hot-rolled sheet; and therefore, comparison and evaluation of the toughness (impact value) of the hot-rolled sheet were performed in respective examples by dividing the absorption energy by a unit area (unit is cm$^2$).

Next, high-temperature tensile test specimens were prepared from a cold-rolled sheet that was subjected to the cold-rolled sheet annealing, and high-temperature tensile tests were performed at 600° C. and 800° C., respectively so as to measure 0.2% proof stress (according to JIS G 0567). In addition, in the evaluation on the high-temperature strength, a case in which 600° C. proof stress was 150 MPa or more and 800° C. proof stress was 30 MPa or more was regarded as pass.

Next, a Lankford value was measured at an ordinary temperature (according to JIS Z 2254). In addition, the test specimens were collected in three directions including a direction parallel (0°) with a rolling direction of a steel sheet surface, a direction inclined at 45° to the rolling direction, and a direction inclined at 90° to the rolling direction, respectively. In addition, with regard to evaluation on workability, a case in which an average Lankford value of measured values obtained in the three directions was in a range of 1.1 or more was regarded as "very excellent". However, it is not necessary to accomplish the above-described numerical value, and a case in which the average value was in a range of 0.9 or more was determined as "satisfactory".

The above-described production conditions and evaluation results are shown in Tables 3 and 4.

TABLE 1

| | Kinds of steel | Component composition (% by mass) | | | | | | | | | | | | | | | | | |
|---|---|---|---|---|---|---|---|---|---|---|---|---|---|---|---|---|---|---|---|
| | | C | Si | Mn | P | S | Cr | Ni | Cu | Ti | V | Al | B | N | Mo | Nb | Zr | Sn | Ti/(C + N) |
| Invention Examples | 0A | 0.006 | 0.62 | 0.006 | 0.027 | 0.001 | 14.3 | 0.02 | 1.23 | 0.18 | — | 0.03 | — | 0.0075 | — | — | — | — | 13.3 |
| | 0B | 0.005 | 0.45 | 0.005 | 0.027 | 0.001 | 14.0 | 0.01 | 1.24 | 0.14 | — | 0.05 | — | 0.0078 | — | — | — | — | 10.9 |
| | 0C | 0.005 | 0.63 | 0.005 | 0.029 | 0.003 | 17.2 | 0.09 | 1.18 | 0.18 | — | 0.30 | — | 0.0075 | — | — | — | — | 14.4 |
| | 1 | 0.002 | 0.45 | 0.42 | 0.026 | 0.001 | 14.0 | 0.09 | 1.20 | 0.08 | 0.05 | 0.05 | 0.0006 | 0.0055 | — | — | — | — | 10.7 |
| | 2 | 0.002 | 0.42 | 0.52 | 0.028 | 0.002 | 14.1 | 0.08 | 1.21 | 0.23 | 0.04 | 0.04 | 0.0004 | 0.0078 | — | — | — | — | 23.5 |
| | 3 | 0.020 | 0.41 | 0.46 | 0.027 | 0.001 | 14.3 | 0.02 | 1.22 | 0.30 | 0.03 | 0.07 | 0.0008 | 0.0040 | — | — | — | — | 12.5 |
| | 4 | 0.005 | 0.10 | 0.45 | 0.025 | 0.001 | 14.0 | 0.06 | 1.23 | 0.25 | 0.02 | 0.06 | 0.0003 | 0.0065 | — | — | — | — | 21.7 |
| | 5 | 0.004 | 1.50 | 0.42 | 0.027 | 0.003 | 17.2 | 0.09 | 1.24 | 0.21 | 0.05 | 0.02 | 0.0002 | 0.0062 | — | — | — | — | 20.6 |
| | 6 | 0.005 | 0.57 | 0.20 | 0.028 | 0.001 | 14.0 | 0.04 | 1.26 | 0.14 | 0.05 | 0.01 | 0.0008 | 0.0075 | — | — | — | — | 11.2 |
| | 7 | 0.003 | 0.51 | 1.50 | 0.027 | 0.001 | 14.0 | 0.02 | 1.28 | 0.17 | 0.04 | 0.04 | 0.0005 | 0.0078 | — | — | — | — | 15.7 |
| | 8 | 0.006 | 0.45 | 0.49 | 0.010 | 0.002 | 16.7 | 0.01 | 1.29 | 0.18 | 0.03 | 0.05 | 0.0002 | 0.0075 | — | — | — | — | 13.3 |
| | 9 | 0.005 | 0.48 | 0.62 | 0.035 | 0.001 | 14.0 | 0.09 | 1.21 | 0.14 | 0.05 | 0.03 | 0.0004 | 0.0072 | — | — | — | — | 11.5 |
| | 10 | 0.005 | 0.45 | 0.45 | 0.025 | 0.010 | 14.1 | 0.01 | 1.23 | 0.18 | 0.06 | 0.05 | 0.0003 | 0.0074 | — | — | — | — | 14.5 |
| | 11 | 0.006 | 0.52 | 0.40 | 0.026 | 0.001 | 10.0 | 0.06 | 1.24 | 0.16 | 0.02 | 0.30 | 0.0008 | 0.0082 | — | — | — | — | 11.3 |
| | 12 | 0.005 | 0.61 | 0.45 | 0.027 | 0.007 | 17.0 | 0.01 | 1.18 | 0.14 | 0.01 | 0.07 | 0.0007 | 0.0075 | — | — | — | — | 11.2 |
| | 13 | 0.005 | 0.45 | 0.67 | 0.027 | 0.001 | 20.0 | 0.02 | 1.19 | 0.16 | 0.06 | 0.06 | 0.0008 | 0.0083 | — | — | — | — | 12.0 |
| | 14 | 0.005 | 0.62 | 0.45 | 0.028 | 0.001 | 14.0 | 1.50 | 1.17 | 0.15 | 0.10 | 0.05 | 0.0006 | 0.0075 | — | — | — | 0.1 | 12.0 |
| | 15 | 0.007 | 0.45 | 0.41 | 0.027 | 0.002 | 15.1 | 0.07 | 1.00 | 0.16 | 0.15 | 0.02 | 0.0008 | 0.0081 | — | — | — | — | 10.6 |
| | 16 | 0.005 | 0.63 | 0.45 | 0.027 | 0.001 | 16.1 | 0.50 | 3.00 | 0.19 | 0.30 | 0.07 | 0.0005 | 0.0087 | — | — | — | — | 13.9 |
| | 17 | 0.005 | 0.45 | 0.67 | 0.029 | 0.001 | 14.0 | 0.06 | 1.16 | 0.18 | 0.15 | 0.08 | 0.0002 | 0.0070 | — | — | — | — | 15.0 |
| | 18 | 0.004 | 0.45 | 0.45 | 0.027 | 0.001 | 18.0 | 0.02 | 1.50 | 0.15 | 0.03 | 0.09 | 0.0030 | 0.0075 | — | — | — | — | 13.0 |
| | 19 | 0.005 | 0.87 | 0.45 | 0.027 | 0.003 | 14.0 | 0.06 | 1.00 | 0.15 | 0.02 | 0.01 | 0.0008 | 0.0050 | — | — | 0.05 | — | 15.0 |
| | 20 | 0.005 | 0.45 | 0.44 | 0.025 | 0.001 | 17.8 | 0.05 | 1.80 | 0.26 | 0.04 | 0.07 | 0.0002 | 0.0200 | — | — | — | — | 10.4 |
| | 21 | 0.005 | 0.45 | 0.51 | 0.027 | 0.001 | 14.0 | 0.02 | 1.20 | 0.14 | 0.06 | 0.03 | 0.0003 | 0.0076 | 0.3 | — | — | — | 11.1 |
| | 22 | 0.009 | 0.95 | 0.45 | 0.024 | 0.008 | 16.3 | 0.09 | 1.90 | 0.18 | 0.05 | 0.30 | 0.0008 | 0.0081 | 0.2 | 0.3 | — | — | 10.5 |
| | 23 | 0.004 | 0.81 | 0.58 | 0.027 | 0.001 | 14.0 | 0.02 | 1.04 | 0.17 | 0.09 | 0.04 | 0.0005 | 0.0070 | — | — | 0.3 | — | 15.5 |
| | 24 | 0.005 | 0.45 | 0.45 | 0.026 | 0.006 | 17.2 | 0.03 | 1.20 | 0.14 | 0.07 | 0.02 | 0.0004 | 0.0067 | — | — | — | 0.5 | 12.0 |

TABLE 2

| | Kinds of steel | Component composition (% by mass) | | | | | | | | | | | | | | | | | |
|---|---|---|---|---|---|---|---|---|---|---|---|---|---|---|---|---|---|---|---|
| | | C | Si | Mn | P | S | Cr | Ni | Cu | Ti | V | Al | B | N | Mo | Nb | Zr | Sn | Ti/(C + N) |
| Comparative Examples | 25 | 0.021 | 0.45 | 0.21 | 0.025 | 0.001 | 14.0 | 0.02 | 1.50 | 0.18 | 0.04 | 0.02 | 0.0005 | 0.0085 | — | — | — | — | 6.1 |
| | 26 | 0.005 | 1.60 | 0.63 | 0.024 | 0.002 | 19.0 | 0.01 | 1.20 | 0.15 | 0.05 | 0.06 | 0.0005 | 0.0083 | — | — | — | — | 11.3 |
| | 27 | 0.005 | 0.41 | 1.60 | 0.021 | 0.001 | 10.0 | 0.06 | 1.15 | 0.16 | 0.04 | 0.07 | 0.0004 | 0.0054 | — | — | — | — | 15.4 |
| | 28 | 0.004 | 0.42 | 0.63 | 0.040 | 0.001 | 14.0 | 0.09 | 1.21 | 0.14 | 0.06 | 0.05 | 0.0003 | 0.0065 | — | — | — | — | 13.3 |
| | 29 | 0.003 | 0.46 | 0.41 | 0.027 | 0.020 | 14.2 | 0.03 | 1.25 | 0.15 | 0.05 | 0.05 | 0.0002 | 0.0076 | — | — | — | — | 14.2 |
| | 30 | 0.005 | 0.48 | 0.65 | 0.026 | 0.001 | 9.8 | 0.05 | 1.21 | 0.15 | 0.05 | 0.04 | 0.0008 | 0.0087 | — | — | — | — | 10.9 |
| | 31 | 0.007 | 0.51 | 0.50 | 0.027 | 0.001 | 21.0 | 0.02 | 1.18 | 0.17 | 0.04 | 0.03 | 0.0008 | 0.0092 | — | — | — | — | 10.5 |
| | 32 | 0.006 | 0.41 | 0.56 | 0.027 | 0.003 | 11.0 | 1.60 | 1.17 | 0.17 | 0.04 | 0.05 | 0.0007 | 0.0088 | — | — | — | — | 11.5 |
| | 33 | 0.005 | 0.53 | 0.59 | 0.027 | 0.001 | 14.9 | 0.09 | 0.80 | 0.14 | 0.06 | 0.05 | 0.0006 | 0.0082 | — | — | — | — | 10.6 |
| | 34 | 0.002 | 0.55 | 0.48 | 0.340 | 0.003 | 14.0 | 0.01 | 3.10 | 0.21 | 0.08 | 0.07 | 0.0008 | 0.0078 | — | — | — | — | 21.4 |
| | 35 | 0.008 | 0.45 | 0.69 | 0.027 | 0.001 | 15.2 | 0.09 | 1.25 | 0.05 | 0.07 | 0.02 | 0.0009 | 0.0095 | — | — | — | — | 2.9 |
| | 36 | 0.005 | 0.45 | 0.45 | 0.025 | 0.005 | 14.0 | 0.00 | 1.30 | 0.31 | 0.08 | 0.03 | 0.0008 | 0.0105 | — | — | — | — | 20.0 |
| | 37 | 0.006 | 0.62 | 0.78 | 0.035 | 0.001 | 18.2 | 0.06 | 1.40 | 0.21 | 0.40 | 0.06 | 0.0007 | 0.0150 | — | — | — | — | 10.0 |
| | 38 | 0.004 | 0.62 | 0.47 | 0.300 | 0.003 | 14.7 | 0.02 | 1.34 | 0.22 | 0.05 | 0.40 | 0.0008 | 0.0096 | — | — | — | — | 16.2 |
| | 39 | 0.005 | 0.45 | 0.87 | 0.027 | 0.005 | 16.5 | 0.09 | 1.26 | 0.23 | 0.06 | 0.05 | 0.0040 | 0.0078 | — | — | — | — | 18.0 |
| | 40 | 0.006 | 0.62 | 0.92 | 0.035 | 0.001 | 18.2 | 0.06 | 1.00 | 0.15 | 0.05 | 0.04 | 0.0005 | 0.0210 | — | — | — | — | 5.6 |
| | 41 | 0.004 | 0.62 | 0.47 | 0.024 | 0.003 | 14.7 | 0.02 | 1.34 | 0.22 | 0.05 | 0.05 | 0.0008 | 0.0096 | 0.5 | — | — | — | 16.2 |
| | 42 | 0.005 | 0.45 | 0.87 | 0.027 | 0.005 | 17.2 | 0.02 | 1.26 | 0.23 | 0.06 | 0.05 | 0.0004 | 0.0075 | — | 0.5 | — | — | 18.4 |
| | 43 | 0.003 | 0.38 | 0.41 | 0.024 | 0.001 | 14.6 | 0.07 | 1.20 | 0.21 | 0.04 | 0.05 | 0.0006 | 0.0135 | — | — | 0.5 | — | 12.7 |
| | 44 | 0.006 | 0.45 | 0.46 | 0.030 | 0.001 | 17.0 | 0.08 | 1.31 | 0.19 | 0.05 | 0.06 | 0.0004 | 0.0120 | — | — | — | 0.6 | 10.6 |

TABLE 3

| Test Nos. | Kinds of steel | Coiling temperature (° C.) | L value | Vickers hardness Hv5 | Impact value (J/cm$^2$) | Cold rolling work roll | High-temperature strength | Lankford value | Others | Remarks |
|---|---|---|---|---|---|---|---|---|---|---|
| P1 | 1 | 330 | 13,622 | 205 | 100 | Large-diameter roll | ○ | 1.02 | | Comparative Example |
| P2 | 1 | 330 | 13,622 | 190 | 105 | Large-diameter roll | ○ | 1.06 | | Comparative Example |
| P3 | 1 | 330 | 13,622 | 202 | 110 | Large-diameter roll | ○ | 1.05 | | Comparative Example |
| P4 | 1 | 330 | 14,229 | 198 | 80 | Large-diameter roll | ○ | 0.92 | | Comparative Example |
| P5 | 1 | 500 | 15,646 | 261 | 10 | Large-diameter roll | ○ | 0.85 | | Comparative Example |
| P6 | 1 | 550 | 16,658 | 272 | 10 | Large-diameter roll | ○ | 0.80 | | Comparative Example |
| P7 | 1 | 600 | 17,670 | 251 | 19 | Large-diameter roll | ○ | 0.82 | | Comparative Example |
| P8 | 1 | 620 | 18,074 | 221 | 108 | Large-diameter roll | ○ | 1.15 | | Invention Example |
| P9 | 1 | 650 | 18,682 | 230 | 98 | Large-diameter roll | ○ | 1.30 | | Invention Example |
| P10 | 1 | 750 | 20,706 | 203 | 100 | Large-diameter roll | ○ | 1.35 | | Invention Example |
| P11A | 0A | 650 | 18,682 | 185 | 125 | Large-diameter roll | ○ | 1.30 | | Invention Example |
| P11B | 0B | 650 | 18,682 | 201 | 107 | Large-diameter roll | ○ | 1.28 | | Invention Example |
| P11C | 0C | 650 | 18,682 | 198 | 118 | Large-diameter roll | ○ | 1.18 | | Invention Example |
| P12 | 2 | 520 | 16,050 | 263 | 17 | Large-diameter roll | ○ | 0.85 | | Comparative Example |
| P13 | 2 | 580 | 17,265 | 251 | 10 | Large-diameter roll | ○ | 0.96 | | Comparative Example |
| P14 | 2 | 550 | 16,658 | 278 | 5 | Large-diameter roll | ○ | 0.85 | | Comparative Example |
| P15 | 2 | 330 | 13,622 | 201 | 78 | Large-diameter roll | ○ | 0.98 | | Comparative Example |
| P16 | 3 | 650 | 18,682 | 218 | 80 | Large-diameter roll | ○ | 1.36 | | Invention Example |
| P17 | 4 | 650 | 17,040 | 234 | 30 | Large-diameter roll | ○ | 1.15 | | Invention Example |
| P18 | 5 | 650 | 18,682 | 218 | 68 | Large-diameter roll | ○ | 1.36 | | Invention Example |
| P19 | 6 | 630 | 18,277 | 217 | 75 | Large-diameter roll | ○ | 1.40 | | Invention Example |
| P20 | 7 | 620 | 18,074 | 224 | 89 | Large-diameter roll | ○ | 1.28 | | Invention Example |
| P21 | 8 | 660 | 18,884 | 229 | 56 | Small-diameter roll | ○ | 1.11 | | Invention Example |
| P22 | 9 | 650 | 18,682 | 197 | 84 | Large-diameter roll | ○ | 1.36 | | Invention Example |
| P23 | 10 | 670 | 16,500 | 185 | 35 | Large-diameter roll | ○ | 1.12 | | Invention Example |
| P24 | 11 | 680 | 19,289 | 180 | 78 | Large-diameter roll | ○ | 1.38 | | Invention Example |
| P25 | 12 | 650 | 18,682 | 227 | 56 | Small-diameter roll | ○ | 1.10 | | Invention Example |
| P26 | 13 | 720 | 20,098 | 213 | 55 | Large-diameter roll | ○ | 1.42 | | Invention Example |
| P27 | 14 | 730 | 20,301 | 216 | 98 | Large-diameter roll | ○ | 1.25 | | Invention Example |
| P28 | 15 | 650 | 18,682 | 225 | 70 | Large-diameter roll | ○ | 1.35 | | Invention Example |
| P29 | 16 | 800 | 21,718 | 218 | 100 | Large-diameter roll | ○ | 1.24 | Pickling of hot-rolled sheet was poor | Comparative Example |
| P30 | 17 | 820 | 22,122 | 218 | 120 | Large-diameter roll | ○ | 1.18 | Pickling of hot-rolled sheet was poor | Comparative Example |
| P31 | 18 | 670 | 19,086 | 223 | 85 | Large-diameter roll | ○ | 1.36 | | Invention Example |

TABLE 4

| Test Nos. | Kinds of steel | Coiling temperature (° C.) | L value | Vickers hardness Hv5 | Impact value (J/cm$^2$) | Cold rolling work roll | High-temperature strength | Lankford value | Others | Remarks |
|---|---|---|---|---|---|---|---|---|---|---|
| P32 | 19 | 690 | 19,491 | 230 | 74 | Large-diameter roll | ○ | 1.26 | | Invention Example |
| P33 | 20 | 650 | 18,682 | 231 | 68 | Large-diameter roll | ○ | 1.42 | | Invention Example |
| P34 | 21 | 700 | 19,694 | 228 | 58 | Large-diameter roll | ○ | 1.25 | | Invention Example |
| P35 | 22 | 660 | 18,884 | 227 | 82 | Large-diameter roll | ○ | 1.36 | | Invention Example |
| P36 | 23 | 670 | 19,086 | 225 | 85 | Large-diameter roll | ○ | 1.25 | | Invention Example |
| P37 | 24 | 650 | 18,682 | 223 | 86 | Large-diameter roll | ○ | 1.25 | | Invention Example |
| P38 | 25 | 650 | 18,682 | 220 | 10 | Large-diameter roll | ○ | 0.75 | | Comparative Example |
| P39 | 26 | 650 | 18,682 | 248 | 10 | Large-diameter roll | ○ | 1.25 | | Comparative Example |
| P40 | 27 | 650 | 18,682 | 241 | 10 | Large-diameter roll | | 0.85 | | Comparative Example |
| P41 | 28 | 650 | 18,682 | 240 | 10 | Large-diameter roll | ○ | 1.10 | | Comparative Example |
| P42 | 29 | 650 | 18,682 | 215 | 55 | Large-diameter roll | X | 1.25 | | Comparative Example |
| P43 | 30 | 650 | 18,682 | 240 | 80 | Large-diameter roll | X | 0.99 | | Comparative Example |
| P44 | 31 | 650 | 18,682 | 241 | 10 | Large-diameter roll | ○ | 0.85 | | Comparative Example |
| P45 | 32 | 650 | 18,682 | 235 | 10 | Large-diameter roll | X | 0.99 | | Comparative Example |
| P46 | 33 | 650 | 18,682 | 215 | 80 | Large-diameter roll | X | 1.30 | | Comparative Example |
| P47 | 34 | 650 | 18,682 | 248 | 10 | Large-diameter roll | X | 0.97 | | Comparative Example |
| P48 | 35 | 650 | 18,682 | 221 | 10 | Large-diameter roll | ○ | 0.98 | | Comparative Example |
| P49 | 36 | 650 | 18,682 | 215 | 10 | Large-diameter roll | ○ | 1.11 | | Comparative Example |
| P50 | 37 | 650 | 18,682 | 223 | 10 | Large-diameter roll | ○ | 1.17 | | Comparative Example |
| P51 | 38 | 650 | 18,682 | 226 | 10 | Large-diameter roll | ○ | 1.16 | | Comparative Example |
| P52 | 39 | 650 | 18,682 | 227 | 10 | Large-diameter roll | ○ | 1.16 | | Comparative Example |
| P53 | 40 | 650 | 18,682 | 244 | 10 | Large-diameter roll | ○ | 0.98 | | Comparative Example |
| P54 | 41 | 650 | 18,682 | 219 | 10 | Large-diameter roll | ○ | 1.06 | | Comparative Example |
| P55 | 42 | 650 | 18,682 | 214 | 10 | Large-diameter roll | ○ | 0.97 | | Comparative Example |
| P56 | 43 | 650 | 18,682 | 209 | 10 | Large-diameter roll | X | 1.25 | | Comparative Example |
| P57 | 44 | 650 | 18,682 | 254 | 10 | Large-diameter roll | X | 1.15 | | Comparative Example |
| P58 | 0A | 620 | 18,074 | 221 | 108 | Large-diameter roll | ○ | 1.17 | | Invention Example |
| P59 | 0A | 650 | 18,682 | 230 | 98 | Large-diameter roll | ○ | 1.18 | | Invention Example |
| P60 | 0A | 750 | 20,706 | 203 | 100 | Large-diameter roll | ○ | 1.16 | | Invention Example |
| P61 | 0A | 520 | 16,050 | 263 | 17 | Large-diameter roll | ○ | 1.15 | | Comparative Example |
| P62 | 0A | 580 | 17,265 | 251 | 10 | Large-diameter roll | ○ | 1.16 | | Comparative Example |
| P63 | 0A | 550 | 16,658 | 278 | 5 | Large-diameter roll | ○ | 1.18 | | Comparative Example |

As is clear from Tables 3 and 4, it can be understood that in the case of the invention examples produced under the component compositions and coiling conditions to which the invention was applied, the toughness of the hot-rolled sheet is better than that of the comparative examples. In addition, it can be understood that the Lankford value that is an index of workability, and the high-temperature strength at 600° C. and 800° C. are high. That is, according to the production method to which the invention is applied, a hot-rolled ferritic stainless steel sheet having excellent toughness and high-temperature strength can be produced. In addition, even in the case where the cold rolling is performed using the hot-rolled steel sheet according to the invention, a satisfactory cold-rolled sheet can be obtained without deterioration of workability.

In addition, even in Test Nos. P58 to P60 that were subjected to the hot-rolled sheet annealing, it can be understood that the same effect as the invention examples in which the hot-rolled sheet annealing was omitted is obtained.

With regard to Test Nos. P1 to P4, and P15, since the coiling temperature was set to be in a range of lower than 450° C., Cu in steel sheet could be solid-solubilized, and as a result, a satisfactory toughness value was secured. However, since Cu was solid-solubilized in an oversaturation manner during a temperature rising process in the cold-rolled sheet annealing and Cu precipitated as Cu-rich clusters, the Lankford value decreased, and workability deteriorated.

With regard to Test Nos. P5 to P7 and P12 to P14, the coiling temperature was within a low-temperature range that was higher than 450° C. and lower than 650° C. Therefore, the Cu-rich clusters precipitated; and thereby, a Vickers hardness greatly increased. In addition, the toughness of the hot-rolled sheet was poor, and the Lankford value greatly decreased.

With regard to Test Nos. P29 and P30, since the coiling temperature was set to a high temperature that was higher than 750° C., toughness was good, but pickling properties were poor. The reason of this result is considered as follows. Since the coiling temperature was high, oxidation of the hot-rolled coil proceeded; and therefore, a long period of time was taken to remove an oxidized scale on a hot-rolled sheet surface during the pickling process of the hot-rolled steel sheet.

In Test Nos. P38 and P53, since each of the contents of C and N deviated from the upper limit, the toughness of the hot-rolled sheet became low due to precipitation of Cr carbonitrides at grain boundaries. Furthermore, since the contents of C and N were large, a value of Ti/(C+N) was low. That is, since the content of C or N was too large with respect to the content of Ti, solid-solubilized C and solid-solubilized N were not sufficiently fixed as carbonitrides of Ti and the like. As a result, development of a recrystallization texture of {222} plane was inhibited during the cold-rolled sheet annealing; and thereby, the Lankford value decreased.

In addition, with regard to Test No. P53, the Vickers hardness increased. The reason of this increase is considered to be because the content of N was too large; and therefore, Cr nitrides precipitated, and hardening occurred.

In Test No. P39, the content of Si was large, and the Lankford value was satisfactory. However, toughness was poor due to solid-solution strengthening.

In Test Nos. P40 and P45, each of the contents of Mn and Ni was large; and therefore, the toughness of the hot-rolled sheet deteriorated due to precipitation of γ-phase, and at the same time, the high-temperature strength and the Lankford value were also deteriorated.

In Test No. P41, the content of P was large, and toughness was poor.

In Test No. P 42, the content of S was large, and the high-temperature strength was poor due to an increase in an amount of precipitation of MnS.

In Test No. P43, since the content of Cr was small, high-temperature oxidation proceeded; and thereby, high-temperature strength deteriorated. In addition, the Lankford value of the cold-rolled sheet was poor due to precipitation of γ-phase during hot rolling.

On the other hand, in Test No. P44, since the content of Cr was large, 475° C. brittleness occurred; and thereby, toughness became poor and the Lankford value also deteriorated.

In Test No. P46, since the content of Cu was small, a satisfactory result was obtained with regard to toughness, but sufficient high-temperature strength was not obtained.

On the other hand, in Test No. P47, since an excessive amount of Cu was added, an amount of Cu-based precipitates increased too much; and thereby, the toughness of the hot-rolled sheet, the Lankford value, and the high-temperature strength decreased.

In Test No. P48, since the content of Ti was small, and the solid-solubilized C and solid-solubilized N were not sufficiently fixed, Cr carbonitrides precipitated at grain boundaries. As a result, the toughness and the Lankford value decreased.

In Test Nos. P49 and P50, since the contents of Ti and V deviated from the upper limits, precipitates became coarse; and thereby, the toughness of the hot-rolled sheet decreased due to the coarse precipitates.

In Test No. P51, since the content of Al deviated from the upper limit, hardening occurred; and thereby, uniform elongation was greatly decreased. In addition, the toughness of the hot-rolled sheet also decreased.

In Test No. P52, since the content of B deviated from the upper limit, a large amount of $Cr_2B$ precipitated; and thereby, the toughness of the hot-rolled sheet decreased.

In Test Nos. P54 and P55, since each of the contents of the Mo and Nb exceeded the upper limit, the Laves phase precipitated in the hot-rolled sheet; and thereby, the toughness was deteriorated. In addition, the Lankford value also decreased.

In Test No. P56, since the content of Zr exceeded the upper limit, the toughness of the hot-rolled sheet decreased, and at the same time, the high-temperature strength also decreased.

In Test No. P57, since the content of Sn exceeded the upper limit, the toughness decreased due to solid-solution strengthening by Sn, and at the same time, the high-temperature strength also decreased due to a decrease in oxidation resistance.

In addition, in Test Nos. P61 to P63, the hot-rolled sheet annealing was performed, but similarly to Test Nos. P5 to P7, and P12 to P14, the coiling temperature was in a low temperature range that was higher than 450° C. and lower than 650° C. Therefore, the Cu-rich clusters precipitated; and thereby, a Vickers hardness greatly increased, and the toughness of the hot-rolled sheet also decreased.

Example 2

In this example, first, each steel having a component composition shown in Tables 5 and 6 was melted and the steel was casted into a slab. Similarly to Example 1, the slab was heated to 1,190° C., and the slab was hot-rolled to have a sheet thickness of 5 mm under a condition where a finish temperature was set to be in a range of 800° C. to 950° C.; and whereby, a hot-rolled steel sheet is formed.

Next, an average cooling rate in a temperature range of 850° C. to 450° C. was set to a predetermined rate as shown in Tables 7 and 8, and the hot-rolled steel sheet was cooled to respective coiling temperatures shown in Tables 7 and 8 with water cooling. Then, the hot-rolled steel sheet was coiled at a predetermined coiling temperature shown in Tables 7 and 8; and whereby, a hot-rolled coil was obtained. In addition, a steel sheet temperature after the hot rolling was measured while monitoring the temperature by a radiation therometer.

Subsequently, the hot-rolled coil was subjected to cold rolling by the same method as Example 1; and whereby, a cold-rolled sheet was obtained. In addition, rolling work rolls as shown in Tables 7 and 8 were used during the cold rolling. Here, with respect to Test Nos. P58 to P64 in Tables 7 and 8, before performing the pickling, hot-rolled sheet annealing was performed under conditions where an annealing temperature was set to 950° C., an annealing time was set to 120 seconds, and an atmosphere was set to a combustion gas atmosphere.

After the cold rolling, the cold-rolled sheet annealing was performed in a combustion gas atmosphere, and then pickling was performed; and whereby, a product sheet was obtained. In addition, in this example, an average temperature rising rate in the cold-rolled sheet annealing was set to 7° C./s.

In addition, the pickling of the hot-rolled coil was performed at a sheet passing speed with which a pickling time became 140 seconds. In addition, as shown in Tables 7 and 8, pickling properties of the hot-rolled sheet were evaluated, and a case in which scales did not remain was regarded as pass (○). In addition, a remaining condition of the scales was confirmed by a loupe.

In the cold rolling, either one of unidirectional multi-pass rolling using a rolling mill provided with large-diameter rolls (having a diameter of 400 mm), or reverse type multi-pass rolling using a rolling mill provided with small-diameter rolls (having a diameter of 100 mm) was performed.

In addition, a cold-rolled sheet annealing temperature was set to be in a range of 880° C. to 950° C. so as to realize a grain size number of approximately 6 to 8. In addition, in comparative examples in which the content of Nb deviated from the upper limit of the invention, the cold-rolled sheet annealing temperature was set to be in a range of 1,000° C. to 1,050° C.

Steel Nos. 0A to 0C and 1 to 24 in Tables 5 and 6 represent invention examples, and steel Nos. 25 to 44 represent comparative examples.

V-notched Charpy impact test specimens were prepared from the middle portion and the bottom portion of the hot-rolled coil obtained in this manner, and a Charpy test was performed at 20° C. to measure absorption energy. The Charpy test was performed according to JIS Z 2242, and evaluation was performed in such a manner that an impact value of 20 J/cm$^2$ or more was regarded as pass (○) and an impact value of less than 20 J/cm2 was regarded as failure (x).

In addition, the test specimens in this example were sub-sized test specimens having the sheet thickness of the hot-rolled sheet; and therefore, comparison and evaluation of toughness (impact value) were performed in respective examples by dividing the absorption energy by a unit area (unit is cm$^2$).

Next, high-temperature tensile test specimens were prepared from a cold-rolled sheet that was subjected to the cold-rolled sheet annealing, and high-temperature tensile tests were performed at 600° C. and 800° C., respectively to measure 0.2% proof stress (according to JIS G 0567). In addition, in the evaluation on the high-temperature strength, a case in which 600° C. proof stress was 150 MPa or more and 800° C. proof stress was 30 MPa or more was regarded as pass.

Next, a Lankford value was measured at an ordinary temperature (according to JIS Z 2254). In addition, test specimens were collected by the same method as Example 1. In addition, with regard to evaluation on workability, a case in which an average value of respective Lankford values obtained in the three directions was in a range of 1.1 or more was regarded as "very excellent". However, it is not necessary to accomplish the above-described numerical value, and a case in which the average value was in a range of 0.9 or more was determined as "satisfactory".

The above-described production conditions and evaluation results are shown in Tables 7 and 8.

TABLE 5

| | Kinds of steel | Component composition (% by mass) | | | | | | | | | | | | | | | | | |
|---|---|---|---|---|---|---|---|---|---|---|---|---|---|---|---|---|---|---|---|
| | | C | Si | Mn | P | S | Cr | Ni | Cu | Ti | V | Al | B | N | Mo | Nb | Zr | Sn | Ti/(C + N) |
| Invention Examples | 0A | 0.005 | 0.25 | 0.12 | 0.026 | 0.001 | 14.5 | 0.02 | 1.21 | 0.15 | — | 0.04 | — | 0.0068 | — | — | — | — | 12.7 |
| | 0B | 0.004 | 0.35 | 0.35 | 0.017 | 0.001 | 17.1 | 0.03 | 1.22 | 0.13 | — | 0.03 | — | 0.0059 | — | — | — | — | 13.1 |
| | 0C | 0.006 | 0.45 | 0.38 | 0.026 | 0.001 | 14.1 | 0.06 | 1.19 | 0.16 | — | 0.03 | — | 0.0078 | — | — | — | — | 11.6 |
| | 1 | 0.005 | 0.45 | 0.42 | 0.026 | 0.001 | 14.0 | 0.09 | 1.20 | 0.15 | 0.05 | 0.05 | 0.0006 | 0.0075 | — | — | — | — | 12.0 |
| | 2 | 0.002 | 0.42 | 0.52 | 0.028 | 0.002 | 14.1 | 0.08 | 1.21 | 0.08 | 0.04 | 0.04 | 0.0004 | 0.0040 | — | — | — | — | 13.3 |
| | 3 | 0.020 | 0.41 | 0.46 | 0.027 | 0.001 | 14.3 | 0.02 | 1.22 | 0.20 | 0.03 | 0.07 | 0.0008 | 0.0045 | — | — | — | — | 8.2 |
| | 4 | 0.005 | 0.10 | 0.45 | 0.025 | 0.001 | 14.0 | 0.06 | 1.23 | 0.25 | 0.02 | 0.06 | 0.0003 | 0.0065 | — | — | — | — | 21.7 |
| | 5 | 0.004 | 1.00 | 0.42 | 0.027 | 0.003 | 17.2 | 0.09 | 1.24 | 0.25 | 0.05 | 0.02 | 0.0002 | 0.0062 | — | — | — | — | 24.5 |
| | 6 | 0.005 | 0.57 | 0.20 | 0.028 | 0.001 | 14.0 | 0.04 | 1.26 | 0.14 | 0.05 | 0.01 | 0.0008 | 0.0075 | — | — | — | — | 11.2 |
| | 7 | 0.003 | 0.51 | 1.00 | 0.027 | 0.001 | 14.0 | 0.02 | 1.28 | 0.17 | 0.04 | 0.04 | 0.0005 | 0.0078 | — | — | — | — | 15.7 |
| | 8 | 0.006 | 0.45 | 0.49 | 0.010 | 0.002 | 16.7 | 0.01 | 1.29 | 0.18 | 0.03 | 0.05 | 0.0002 | 0.0075 | — | — | — | — | 13.3 |
| | 9 | 0.005 | 0.48 | 0.62 | 0.035 | 0.001 | 14.0 | 0.09 | 1.21 | 0.14 | 0.05 | 0.03 | 0.0004 | 0.0072 | — | — | — | — | 11.5 |
| | 10 | 0.005 | 0.45 | 0.45 | 0.025 | 0.010 | 14.1 | 0.01 | 1.23 | 0.18 | 0.06 | 0.05 | 0.0003 | 0.0074 | — | — | — | — | 14.5 |
| | 11 | 0.006 | 0.52 | 0.40 | 0.026 | 0.001 | 13.0 | 0.06 | 1.24 | 0.16 | 0.02 | 0.30 | 0.0008 | 0.0082 | — | — | — | — | 11.3 |
| | 12 | 0.005 | 0.61 | 0.45 | 0.027 | 0.007 | 17.0 | 0.01 | 1.18 | 0.14 | 0.01 | 0.07 | 0.0007 | 0.0075 | — | — | — | — | 11.2 |
| | 13 | 0.005 | 0.45 | 0.67 | 0.027 | 0.001 | 20.0 | 0.02 | 1.19 | 0.16 | 0.06 | 0.06 | 0.0008 | 0.0083 | — | — | — | — | 12.0 |
| | 14 | 0.005 | 0.62 | 0.45 | 0.028 | 0.001 | 14.0 | 1.20 | 1.17 | 0.15 | 0.10 | 0.05 | 0.0006 | 0.0075 | — | — | — | 0.05 | 12.0 |
| | 15 | 0.007 | 0.45 | 0.41 | 0.027 | 0.002 | 15.1 | 0.07 | 1.00 | 0.16 | 0.15 | 0.02 | 0.0008 | 0.0081 | — | — | — | — | 10.6 |
| | 16 | 0.005 | 0.63 | 0.45 | 0.027 | 0.001 | 16.1 | 0.50 | 2.00 | 0.19 | 0.30 | 0.07 | 0.0030 | 0.0087 | — | — | — | — | 13.9 |
| | 17 | 0.005 | 0.45 | 0.67 | 0.029 | 0.001 | 14.0 | 0.06 | 1.16 | 0.18 | 0.15 | 0.08 | 0.0002 | 0.0070 | — | — | — | — | 15.0 |
| | 18 | 0.004 | 0.45 | 0.45 | 0.027 | 0.001 | 18.0 | 0.02 | 1.50 | 0.15 | 0.03 | 0.09 | 0.0030 | 0.0075 | — | — | — | — | 13.0 |
| | 19 | 0.005 | 0.87 | 0.45 | 0.027 | 0.003 | 14.0 | 0.06 | 1.00 | 0.15 | 0.02 | 0.01 | 0.0008 | 0.0050 | — | — | 0.05 | — | 15.0 |
| | 20 | 0.005 | 0.45 | 0.44 | 0.025 | 0.001 | 17.8 | 0.05 | 1.80 | 0.26 | 0.04 | 0.07 | 0.0002 | 0.0200 | — | — | — | — | 10.4 |
| | 21 | 0.005 | 0.45 | 0.51 | 0.027 | 0.001 | 14.0 | 0.02 | 1.20 | 0.14 | 0.06 | 0.03 | 0.0003 | 0.0076 | 0.3 | — | — | — | 11.1 |
| | 22 | 0.009 | 0.95 | 0.45 | 0.024 | 0.008 | 16.3 | 0.09 | 1.90 | 0.18 | 0.05 | 0.30 | 0.0008 | 0.0081 | 0.2 | 0.3 | — | — | 10.5 |
| | 23 | 0.004 | 0.81 | 0.58 | 0.027 | 0.001 | 14.0 | 0.02 | 1.04 | 0.17 | 0.09 | 0.04 | 0.0005 | 0.0070 | — | — | 0.3 | — | 15.5 |
| | 24 | 0.005 | 0.45 | 0.45 | 0.026 | 0.006 | 17.2 | 0.03 | 1.20 | 0.14 | 0.07 | 0.02 | 0.0004 | 0.0067 | — | — | — | 0.5 | 12.0 |

TABLE 6

| | Kinds of steel | Component composition (% by mass) | | | | | | | | | | | | | | | | | |
|---|---|---|---|---|---|---|---|---|---|---|---|---|---|---|---|---|---|---|---|
| | | C | Si | Mn | P | S | Cr | Ni | Cu | Ti | V | Al | B | N | Mo | Nb | Zr | Sn | Ti/(C + N) |
| Comparative Examples | 25 | 0.021 | 0.45 | 0.21 | 0.025 | 0.001 | 14.0 | 0.02 | 1.50 | 0.18 | 0.04 | 0.02 | 0.0005 | 0.0085 | — | — | — | — | 6.1 |
| | 26 | 0.005 | 1.60 | 0.63 | 0.024 | 0.002 | 19.0 | 0.01 | 1.20 | 0.15 | 0.05 | 0.06 | 0.0005 | 0.0083 | — | — | — | — | 11.3 |
| | 27 | 0.005 | 0.41 | 1.60 | 0.021 | 0.001 | 10.0 | 0.06 | 1.15 | 0.16 | 0.04 | 0.07 | 0.0004 | 0.0054 | — | — | — | — | 15.4 |
| | 28 | 0.004 | 0.42 | 0.63 | 0.040 | 0.001 | 14.0 | 0.09 | 1.21 | 0.14 | 0.06 | 0.05 | 0.0003 | 0.0065 | — | — | — | — | 13.3 |
| | 29 | 0.003 | 0.46 | 0.41 | 0.027 | 0.020 | 14.2 | 0.03 | 1.25 | 0.15 | 0.05 | 0.05 | 0.0002 | 0.0076 | — | — | — | — | 14.2 |
| | 30 | 0.005 | 0.48 | 0.65 | 0.026 | 0.001 | 9.8 | 0.05 | 1.21 | 0.15 | 0.05 | 0.04 | 0.0008 | 0.0087 | — | — | — | — | 10.9 |
| | 31 | 0.007 | 0.51 | 0.50 | 0.027 | 0.001 | 21.0 | 0.02 | 1.18 | 0.17 | 0.04 | 0.03 | 0.0008 | 0.0092 | — | — | — | — | 10.5 |
| | 32 | 0.006 | 0.41 | 0.56 | 0.027 | 0.003 | 11.0 | 1.60 | 1.17 | 0.17 | 0.04 | 0.05 | 0.0007 | 0.0088 | — | — | — | — | 11.5 |
| | 33 | 0.005 | 0.53 | 0.59 | 0.027 | 0.001 | 14.9 | 0.09 | 0.80 | 0.14 | 0.06 | 0.05 | 0.0006 | 0.0082 | — | — | — | — | 10.6 |
| | 34 | 0.002 | 0.55 | 0.48 | 0.034 | 0.003 | 14.0 | 0.01 | 3.20 | 0.21 | 0.08 | 0.07 | 0.0008 | 0.0078 | — | — | — | — | 21.4 |
| | 35 | 0.008 | 0.45 | 0.69 | 0.027 | 0.001 | 15.2 | 0.09 | 1.25 | 0.05 | 0.07 | 0.02 | 0.0009 | 0.0095 | — | — | — | — | 2.9 |
| | 36 | 0.005 | 0.45 | 0.45 | 0.025 | 0.005 | 14.0 | 0.00 | 1.30 | 0.36 | 0.08 | 0.03 | 0.0008 | 0.0105 | — | — | — | — | 23.2 |
| | 37 | 0.006 | 0.62 | 0.78 | 0.035 | 0.001 | 18.2 | 0.06 | 1.40 | 0.21 | 0.40 | 0.06 | 0.0007 | 0.0150 | — | — | — | — | 10.0 |
| | 38 | 0.004 | 0.62 | 0.47 | 0.300 | 0.003 | 14.7 | 0.02 | 1.34 | 0.22 | 0.05 | 0.40 | 0.0008 | 0.0096 | — | — | — | — | 16.2 |
| | 39 | 0.005 | 0.45 | 0.87 | 0.027 | 0.005 | 16.5 | 0.09 | 1.26 | 0.23 | 0.06 | 0.05 | 0.0040 | 0.0078 | — | — | — | — | 18.0 |
| | 40 | 0.006 | 0.62 | 0.92 | 0.035 | 0.001 | 18.2 | 0.06 | 1.00 | 0.15 | 0.05 | 0.04 | 0.0005 | 0.0220 | — | — | — | — | 5.4 |
| | 41 | 0.004 | 0.62 | 0.47 | 0.024 | 0.003 | 14.7 | 0.02 | 1.34 | 0.22 | 0.05 | 0.05 | 0.0008 | 0.0096 | 0.5 | — | — | — | 16.2 |
| | 42 | 0.005 | 0.45 | 0.87 | 0.027 | 0.005 | 17.2 | 0.02 | 1.26 | 0.23 | 0.06 | 0.05 | 0.0004 | 0.0075 | — | 0.5 | — | — | 18.4 |
| | 43 | 0.003 | 0.38 | 0.41 | 0.024 | 0.001 | 14.6 | 0.07 | 1.20 | 0.21 | 0.04 | 0.05 | 0.0006 | 0.0135 | — | — | 0.5 | — | 12.7 |
| | 44 | 0.006 | 0.45 | 0.46 | 0.030 | 0.001 | 17.0 | 0.08 | 1.31 | 0.19 | 0.05 | 0.06 | 0.0004 | 0.0120 | — | — | — | 2.0 | 10.6 |

TABLE 7

| Test Nos. | Kinds of steel | Cooling rate between 850° C. and 450° C. (° C./s) | Coiling temperature (° C.) | Vickers hardness Hv5 | | Evaluation of toughness of hot-rolled sheet | | Pickling property of hot-rolled sheet | Cold rolling work roll | High-temperature strength | Lankford value | Remarks |
|---|---|---|---|---|---|---|---|---|---|---|---|---|
| | | | | Middle portion | Bottom portion | Middle portion | Bottom portion | | | | | |
| P1 | 1 | 50 | 30 | 201 | 201 | ◎ | ◎ | ○ | Large-diameter roll | ○ | 0.87 | Comparative Example |
| P2 | 1 | 50 | 200 | 203 | 203 | ◎ | ◎ | ○ | Large-diameter roll | ○ | 0.91 | Comparative Example |
| P3 | 1 | 50 | 300 | 198 | 198 | ◎ | ◎ | ○ | Large-diameter roll | ○ | 0.95 | Comparative Example |
| P4 | 1 | 50 | 350 | 185 | 187 | ◎ | ◎ | ○ | Large-diameter roll | ○ | 1.21 | Invention Example |
| P5 | 1 | 50 | 400 | 187 | 190 | ◎ | ◎ | ○ | Large-diameter roll | ○ | 1.38 | Invention Example |
| P6 | 1 | 50 | 430 | 186 | 191 | ◎ | ◎ | ○ | Large-diameter roll | ○ | 1.36 | Invention Example |
| P7 | 1 | 50 | 450 | 185 | 184 | ○ | ◎ | ○ | Large-diameter roll | ○ | 1.33 | Invention Example |
| P8 | 1 | 0.014 | 500 | 250 | 245 | X | X | ○ | Large-diameter roll | ○ | 0.89 | Comparative Example |
| P9 | 1 | 0.013 | 600 | 245 | 262 | X | X | ○ | Large-diameter roll | ○ | 0.95 | Comparative Example |
| P10 | 1 | 0.012 | 650 | 198 | 258 | ◎ | X | ○ | Large-diameter roll | ○ | 0.85 | Comparative Example |
| P11 | 2 | 1 | 430 | 240 | 250 | X | X | ○ | Large-diameter roll | ○ | 1.02 | Comparative Example |
| P12 | 2 | 5 | 430 | 245 | 251 | X | X | ○ | Large-diameter roll | ○ | 1.06 | Comparative Example |
| P13A | 0A | 50 | 400 | 201 | 210 | ◎ | ◎ | ○ | Large-diameter roll | ○ | 1.3 | Invention Example |
| P13B | 0B | 50 | 400 | 188 | 192 | ◎ | ◎ | ○ | Large-diameter roll | ○ | 1.3 | Invention Example |
| P13C | 0C | 50 | 400 | 187 | 190 | ◎ | ◎ | ○ | Large-diameter roll | ○ | 1.21 | Invention Example |
| P14 | 2 | 10 | 430 | 205 | 215 | ○ | ○ | ○ | Large-diameter roll | ○ | 1.2 | Invention Example |
| P15 | 2 | 20 | 430 | 215 | 213 | ○ | ○ | ○ | Large-diameter roll | ○ | 1.44 | Invention Example |
| P16 | 3 | 50 | 430 | 210 | 212 | ○ | ○ | ○ | Large-diameter roll | ○ | 1.4 | Invention Example |
| P17 | 4 | 50 | 420 | 195 | 189 | ◎ | ◎ | ○ | Large-diameter roll | ○ | 1.51 | Invention Example |
| P18 | 5 | 50 | 450 | 220 | 201 | ○ | ○ | ○ | Large-diameter roll | ○ | 1.27 | Invention Example |

TABLE 7-continued

| Test Nos. | Kinds of steel | Cooling rate between 850° C. and 450° C. (° C./s) | Coiling temperature (° C.) | Vickers hardness Hv5 | | Evaluation of toughness of hot-rolled sheet | | Pickling property of hot-rolled sheet | Cold rolling work roll | High-temperature strength | Lankford value | Remarks |
|---|---|---|---|---|---|---|---|---|---|---|---|---|
| | | | | Middle portion | Bottom portion | Middle portion | Bottom portion | | | | | |
| P19 | 6 | 50 | 410 | 185 | 184 | ◎ | ◎ | ○ | Large-diameter roll | ○ | 1.33 | Invention Example |
| P20 | 7 | 50 | 430 | 213 | 215 | ○ | ○ | ○ | Large-diameter roll | ○ | 1.28 | Invention Example |
| P21 | 8 | 50 | 420 | 179 | 175 | ◎ | ◎ | ○ | Small-diameter roll | ○ | 1.11 | Invention Example |
| P22 | 9 | 50 | 430 | 220 | 218 | ○ | ○ | ○ | Large-diameter roll | ○ | 1.29 | Invention Example |
| P23 | 10 | 50 | 415 | 215 | 219 | ○ | ○ | ○ | Large-diameter roll | ○ | 1.44 | Invention Example |
| P24 | 11 | 50 | 430 | 187 | 191 | ◎ | ◎ | ○ | Large-diameter roll | ○ | 1.48 | Invention Example |
| P25 | 12 | 50 | 380 | 215 | 213 | ○ | ○ | ○ | Small-diameter roll | ○ | 1.16 | Invention Example |
| P26 | 13 | 50 | 430 | 214 | 216 | ○ | ○ | ○ | Large-diameter roll | ○ | 1.54 | Invention Example |
| P27 | 14 | 50 | 370 | 217 | 220 | ○ | ○ | ○ | Large-diameter roll | ○ | 1.49 | Invention Example |
| P28 | 15 | 50 | 430 | 196 | 184 | ◎ | ◎ | ○ | Large-diameter roll | ○ | 1.33 | Invention Example |
| P29 | 16 | 50 | 360 | 221 | 221 | ○ | ○ | ○ | Large-diameter roll | ○ | 1.56 | Invention Example |
| P30 | 17 | 50 | 415 | 184 | 187 | ◎ | ◎ | ○ | Large-diameter roll | ○ | 1.58 | Invention Example |
| P31 | 18 | 50 | 420 | 175 | 179 | ◎ | ◎ | ○ | Large-diameter roll | ○ | 1.45 | Invention Example |
| P32 | 19 | 50 | 430 | 189 | 191 | ◎ | ◎ | ○ | Large-diameter roll | ○ | 1.25 | Invention Example |

TABLE 8

| Test Nos. | Kinds of steel | Cooling rate between 850° C. and 450° C. (° C./s) | Coiling temperature (° C.) | Vickers hardness Hv5 | | Evaluation of toughness of hot-rolled sheet | | Pickling property of hot-rolled sheet | Cold rolling work roll | High-temperature strength | Lankford value | Remarks |
|---|---|---|---|---|---|---|---|---|---|---|---|---|
| P33 | 20 | 50 | 420 | 209 | 219 | ○ | ○ | ○ | Large-diameter roll | ○ | 1.46 | Invention Example |
| P34 | 21 | 50 | 410 | 196 | 187 | ◎ | ◎ | ○ | Large-diameter roll | ○ | 1.23 | Invention Example |
| P35 | 22 | 50 | 450 | 210 | 211 | ○ | ○ | ○ | Large-diameter roll | ○ | 1.38 | Invention Example |
| P36 | 23 | 50 | 430 | 186 | 185 | ◎ | ◎ | ○ | Large-diameter roll | ○ | 1.54 | Invention Example |
| P37 | 24 | 50 | 440 | 187 | 185 | ○ | ○ | ○ | Large-diameter roll | ○ | 1.31 | Invention Example |
| P38 | 25 | 50 | 450 | 187 | 201 | X | X | ○ | Large-diameter roll | ○ | 0.89 | Comparative Example |
| P39 | 26 | 50 | 450 | 189 | 192 | X | X | ○ | Large-diameter roll | ○ | 1.15 | Comparative Example |
| P40 | 27 | 50 | 450 | 197 | 201 | X | X | ○ | Large-diameter roll | X | 0.95 | Comparative Example |
| P41 | 28 | 50 | 450 | 187 | 186 | X | X | ○ | Large-diameter roll | ○ | 1.23 | Comparative Example |
| P42 | 29 | 50 | 450 | 185 | 187 | X | X | ○ | Large-diameter roll | X | 1.14 | Comparative Example |
| P43 | 30 | 50 | 450 | 189 | 201 | X | X | ○ | Large-diameter roll | X | 0.87 | Comparative Example |
| P44 | 31 | 50 | 450 | 210 | 215 | X | X | ○ | Large-diameter roll | ○ | 1.29 | Comparative Example |
| P45 | 32 | 50 | 450 | 206 | 198 | X | X | ○ | Large-diameter roll | X | 0.95 | Comparative Example |
| P46 | 33 | 50 | 450 | 175 | 173 | ◎ | ◎ | ○ | Large-diameter roll | X | 1.26 | Comparative Example |

TABLE 8-continued

| Test Nos. | Kinds of steel | Cooling rate between 850° C. and 450° C. (° C./s) | Coiling temperature (° C.) | Vickers hardness Hv5 | | Evaluation of toughness of hot-rolled sheet | | Pickling property of hot-rolled sheet | Cold rolling work roll | High-temperature strength | Lankford value | Remarks |
|---|---|---|---|---|---|---|---|---|---|---|---|---|
| P47 | 34 | 50 | 450 | 187 | 186 | X | X | ○ | Large-diameter roll | X | 0.87 | Comparative Example |
| P48 | 35 | 50 | 450 | 189 | 191 | X | X | ○ | Large-diameter roll | ○ | 0.87 | Comparative Example |
| P49 | 36 | 50 | 450 | 201 | 205 | X | X | ○ | Large-diameter roll | ○ | 1.26 | Comparative Example |
| P50 | 37 | 50 | 450 | 208 | 207 | X | X | ○ | Large-diameter roll | ○ | 1.24 | Comparative Example |
| P51 | 38 | 50 | 450 | 196 | 187 | X | X | ○ | Large-diameter roll | ○ | 1.24 | Comparative Example |
| P52 | 39 | 50 | 450 | 185 | 189 | X | X | ○ | Large-diameter roll | ○ | 1.27 | Comparative Example |
| P53 | 40 | 50 | 450 | 209 | 206 | X | X | ○ | Large-diameter roll | ○ | 0.95 | Comparative Example |
| P54 | 41 | 0.013 | 650 | 205 | 268 | X | X | X | Large-diameter roll | ○ | 0.95 | Comparative Example |
| P55 | 42 | 0.013 | 650 | 205 | 254 | X | X | X | Large-diameter roll | ○ | 1.07 | Comparative Example |
| P56 | 43 | 50 | 450 | 185 | 205 | X | X | ○ | Large-diameter roll | ○ | 1.25 | Comparative Example |
| P57 | 44 | 50 | 450 | 213 | 201 | X | X | ○ | Large-diameter roll | X | 1.15 | Comparative Example |
| P58 | 0A | 50 | 350 | 185 | 187 | ◎ | ◎ | ○ | Large-diameter roll | ○ | 1.18 | Invention Example |
| P59 | 0A | 50 | 400 | 187 | 190 | ◎ | ◎ | ○ | Large-diameter roll | ○ | 1.13 | Invention Example |
| P60 | 0A | 50 | 430 | 186 | 191 | ◎ | ◎ | ○ | Large-diameter roll | ○ | 1.14 | Invention Example |
| P61 | 0A | 50 | 450 | 185 | 184 | ○ | ◎ | ○ | Large-diameter roll | ○ | 1.16 | Invention Example |
| P62 | 0A | 0.014 | 500 | 250 | 245 | X | X | ○ | Large-diameter roll | ○ | 1.12 | Comparative Example |
| P63 | 0A | 0.013 | 600 | 245 | 262 | X | X | ○ | Large-diameter roll | ○ | 1.12 | Comparative Example |
| P64 | 0A | 0.012 | 650 | 198 | 258 | ◎ | X | ○ | Large-diameter roll | ○ | 1.15 | Comparative Example |

As is clear from Tables 7 and 8, it can be understood that in the case of the invention examples produced under the component compositions and coiling conditions to which the invention was applied, the toughness of the hot-rolled sheet, the pickling properties, the high-temperature strength of the cold-rolled annealed sheet, and the Lankford value are better than those of the comparative examples. That is, according to the production method to which the invention is applied, a ferritic stainless steel sheet excellent in workability, toughness, and high-temperature strength can be produced.

In addition, even in Test Nos. P58 to P61 that were subjected to the hot-rolled sheet annealing, it can be understood that the same effect as the invention examples in which the hot-rolled sheet annealing was omitted is obtained.

On the other hand, in comparative examples deviated from the invention examples, at least one of the Charpy impact value (absorption energy), the 0.2% proof stress, and the Lankford value was low. From this result, it can be understood that the toughness, the workability, or the high-temperature strength of the ferritic stainless steel sheet decreased.

In Test No. P1 to P3 of the comparative examples, the coiling temperature was in a range of lower than 350° C. that was low. Therefore, very good results were obtained with regard to the toughness of the hot-rolled sheet, but the Lankford value decreased. The reason of these results is considered as follows. Since the solid-solubilized C and solid-solubilized N were not sufficiently fixed as carbonitrides of Ti and the like, development of a recrystallization texture of {222} plane was inhibited during the cold-rolled sheet annealing. As a result, the Lankford value decreased, and the workability deteriorated.

In Test Nos. P8 and P9, the coiling temperature was in a temperature range that was higher than 450° C. and lower than than 650° C. Therefore, the Cu-rich clusters precipitated, and embrittlement occurred. Due to this embrittlement, the toughness of the hot-rolled sheet was poor, and the Lankford value also greatly decreased.

In Test No. P10, the coiling temperature was set to 650° C. which was high, an amount of temperature drop was greatly different between the middle portion and the bottom portion of the hot-rolled coil. Therefore, the toughness of the middle portion of the hot-rolled coil was very good, but the toughness of the bottom portion was poor; and therefore, the toughness of respective portions of the hot-rolled coil was greatly different. In addition, the Lankford value was low.

In Test Nos. P11 and P12, the coiling temperature was set to 430° C., but the average cooling rate until the coiling was less than 10° C./s. Therefore, the toughness of the hot-rolled sheet decreased. The reason of this decrease is considered to be because the average cooling rate was low; and thereby, the Cu-rich clusters precipitated. In addition, the Lankford value also decreased.

In Test Nos. P38 and P53, since each of the contents of C and N deviated from the upper limit, the toughness of the hot-rolled sheet became low due to precipitation of Cr carbonitrides at grain boundaries. Furthermore, since the contents of C and N were large, a value of Ti/(C+N) became low. That is, since the content of C or N was too large with respect to the content of Ti, solid-solubilized C and solid-solubilized N were not sufficiently fixed as carbonitrides of Ti and the like. As a result, development of a recrystallization texture of {222} plane was inhibited during the cold-rolled sheet annealing; and thereby, an average Lankford value decreased.

In Test No. P39, the content of Si was large, and the Lankford value was satisfactory. However, toughness was poor due to solid-solution strengthening.

In P40 and P45, each of the contents of Mn and Ni was large; and therefore, the toughness of the hot-rolled sheet deteriorated due to precipitation of γ-phase, and at the same time, the high-temperature strength and the Lankford value were also deteriorated.

In Test No. P41, the content of P was large, and toughness was poor.

In Test No. P 42, the content of S was large, and the high-temperature strength was poor due to an increase in an amount of precipitation of MnS.

In Test No. P43, since the content of Cr was small, high-temperature oxidation proceeded; and thereby, high-temperature strength was deteriorated. In addition, the toughness of the hot-rolled sheet or the Lankford value of the cold-rolled sheet was poor due to precipitation of γ-phase during hot rolling.

On the other hand, in Test No. P44, since the content of Cr was large, 475° C. brittleness occurred; and thereby, toughness was poor.

In Test No. P46, since the content of Cu was small, a satisfactory result was obtained with regard to toughness, but sufficient high-temperature strength was not obtained.

On the other hand, in Test No. P47, since an excessive amount of Cu was added, an amount of Cu-based precipitates increased too much; and thereby, the toughness of the hot-rolled sheet, the Lankford value, and the high-temperature strength decreased.

In Test No. P48, since the content of Ti was small and the solid-solubilized C and solid-solubilized N were not sufficiently fixed, Cr carbonitrides precipitated at grain boundaries. As a result, the toughness and the Lankford value decreased.

In Test Nos. P49, P50, P51, and P56, since the contents of Ti, V, Al, and Zr deviated from the upper limit, precipitates became coarse; and thereby, the toughness of the hot-rolled sheet decreased due to the coarse precipitates.

In Test No. P52, since the content of B deviated from the upper limit, a large amount of $Cr_2B$ precipitated; and thereby, the toughness of the hot-rolled sheet decreased.

In Test Nos. P54 and P55, since each of the contents of the Mo and Nb exceeded the upper limit, the Laves phase precipitated in the hot-rolled sheet; and thereby, the toughness was deteriorated. In addition, the pickling properties and the Lankford value also decreased.

In Test No. P57, since the content of Sn exceeded the upper limit, the toughness decreased due to solid-solution strengthening by Sn, and at the same time, the high-temperature strength also decreased due to a decrease in oxidation resistance.

In addition, in Test Nos. P62 to P64, the hot-rolled sheet annealing was performed. However, in Test Nos. P62 and P63, similarly to Test No. P8 and P9, the coiling temperature was in a temperature range that was higher than 450° C. and lower than 650° C. Therefore, the Cu-rich clusters precipitated; and thereby, a Vickers hardness greatly increased, and the toughness of the hot-rolled sheet also decreased. In Test No. 64, the coiling temperature was set to 650° C. which was high; and therefore, an amount of temperature drop was greatly different between the middle portion and the bottom portion of the hot-rolled coil. As a result, the toughness of the middle portion of the hot-rolled coil was very good, but the toughness of the bottom portion was poor; and thereby, the toughness of respective portions of the hot-rolled coil was greatly different.

Among the invention examples, in examples in which the coiling temperature was set to be in a range of 350° C. to 450° C. and the average cooling rate in a temperature range of 850° C. and 450° C. was set to 10° C./s or more after hot rolling, all of the toughness of the hot-rolled sheet, the pickling properties, the high-temperature strength, and the Lankford value were satisfactory.

In addition, in Test Nos. P21 and P25 that are the invention examples, when performing the cold rolling, the rolling mill provided with the small-diameter rolls having a diameter of 100 mm was used. Accordingly, the Lankford value was within a range of a pass level, but was slightly low. From this result, it could be understood that it is preferable to use a rolling mill provided with large-diameter rolls having a diameter of 400 mm when performing the cold rolling.

From these results, the above-described finding was confirmed. In addition, the ground for limiting the above-described steel composition and configuration was proved.

Example 3

In this example, first, each of steels having components shown in Table 9 was melted to obtain a steel ingot. The steel ingot was ground to a thickness of 90 mm, and the steel ingot was rolled by hot rolling to have a sheet thickness of 5 mm; and whereby, a hot-rolled steel sheet was obtained. Next, the hot-rolled steel sheet was cooled by water cooling to a predetermined coiling temperature T(° C.) shown in Table 10 while monitoring a steel sheet temperature after the rolling by a radiation thermometer. In addition, a cooling rate at this time was approximately 20° C./s.

Next, the hot-rolled steel sheet was coiled into a coil shape at the coiling temperature T(° C.). Then, as shown in Table 10, a time taken until the hot-rolled coil was immersed in a water bath was set to t(h), and the hot-rolled steel sheet coiled into a coil shape was immersed in the water bath.

Subsequently, after being immersed in the water bath for an immersion time (h) as shown in Table 10, the hot-rolled steel sheet was taken out. In addition, a time tc(h) in Table 10 is a value calculated from Expression (3), and after the coiling of the hot-rolled steel sheet, it is necessary to immerse the hot-rolled coil in the water bath within the time tc that is the upper limit time so as to exhibit the effect of the invention.

Sizes (maximum diameters) and a number density of the Cu clusters in crystal grains of the hot-rolled steel sheet were measured by the 3D-AP method by using each hot-rolled steel sheet that was obtained. Measurement results are shown in Table 10. In addition, the number density X in Table 10 represents the number density ($\times 10^{13}$ counts/mm$^2$) of the Cu clusters having the maximum diameters of 5 nm or less.

Furthermore, Charpy test specimens were collected from the hot-rolled steel sheet that was obtained in a direction orthogonal to the rolling direction, and the Charpy test was performed at 25° C. to obtain the Charpy impact value. The results are shown in Table 10. In addition, from the results that were obtained, the cold cracking properties of the hot-rolled steel sheet were evaluated by the following method. In addition, the Charpy test was performed according to JIS Z 2242.

In this example, with regard to the method of evaluating the cold cracking properties, in the case where the Charpy impact value was less than 20 J/cm$^2$, cold cracking and the like occurred in subsequent continuous annealing or pickling process; and thereby, a yield ratio decreased. Therefore, this case was determined as failure. In addition, in the case where the Charpy impact value was 20 J/cm$^2$ or more, the cold cracking did not occur.

The above-described production conditions and evaluation results are shown in Table 10.

TABLE 9

| Kinds of steel | Component composition (% by mass) | | | | | | | | | | | | | | |
|---|---|---|---|---|---|---|---|---|---|---|---|---|---|---|---|
| | C | Si | Mn | P | S | Cr | Cu | Al | N | Ti | Nb | Mo | Ni | Al | B |
| A | 0.0088 | 0.26 | 0.55 | 0.026 | 0.002 | 11.7 | 1.1 | 0.007 | 0.0110 | — | — | — | — | — | — |
| B | 0.0095 | 0.44 | 0.30 | 0.035 | 0.003 | 17.6 | 1.8 | 0.004 | 0.0090 | — | — | 0.55 | 0.14 | — | — |
| C | 0.0029 | 0.10 | 0.25 | 0.014 | 0.005 | 16.5 | 1.0 | 0.061 | 0.0068 | 0.24 | — | 0.15 | — | 0.51 | — |
| D | 0.0041 | 0.78 | 0.88 | 0.031 | 0.003 | 18.9 | 2.0 | 0.035 | 0.0121 | — | 0.55 | — | — | — | — |
| E | 0.0041 | 0.78 | 0.88 | 0.031 | 0.003 | 18.9 | 2.0 | 0.068 | 0.0119 | — | 0.55 | — | 0.89 | — | 0.0003 |
| F | 0.0060 | 0.35 | 1.82 | 0.038 | 0.001 | 21.1 | 1.4 | 0.046 | 0.0074 | 0.17 | 0.18 | — | — | — | — |
| G | 0.0080 | 0.21 | 1.02 | 0.025 | 0.001 | 17.0 | 1.3 | 0.008 | 0.0130 | 0.12 | 0.53 | 0.31 | — | | 0.0008 |
| H | 0.0042 | 0.97 | 0.68 | 0.028 | 0.002 | 17.0 | 1.3 | 0.016 | 0.0164 | 0.16 | — | — | — | 2.20 | 0.0023 |
| I | 0.0027 | 0.34 | 0.72 | 0.023 | 0.007 | 19.2 | 1.4 | 0.078 | 0.0087 | — | 0.22 | 0.82 | 0.11 | — | — |
| J | 0.0058 | 0.52 | 0.46 | 0.025 | 0.001 | 13.9 | 1.2 | 0.055 | 0.0078 | 0.14 | — | — | — | — | 0.0008 |
| K | 0.0036 | 0.46 | 1.05 | 0.024 | 0.002 | 26.2 | 1.5 | 0.023 | 0.0068 | 0.08 | 0.49 | 0.48 | 0.51 | — | — |
| L | 0.0089 | 0.35 | 0.92 | 0.031 | 0.002 | 31.1 | 1.2 | 0.009 | 0.0112 | — | 0.32 | — | 0.34 | — | — |

TABLE 10

| Test Nos. | Kinds of steel | Coiling temperature T (° C.) | Time taken until onset of immersion in water bath t (h) | Upper limit time tc (h) | Immersion time (h) | Number density X | Charpy impact value (J/cm$^2$) | Remarks |
|---|---|---|---|---|---|---|---|---|
| 1 | A | 325 | 2.5 | 45.3 | 1.2 | 0.0 | 63 | Invention Example |
| 2 | A | 450 | 1.2 | 1.1 | 1.5 | 4.5 | 15 | Comparative Example |
| 3 | A | 475 | 0.2 | 0.5 | 0.2 | 2.6 | 17 | Comparative Example |
| 4 | B | 500 | 0.2 | 0.24 | 3.0 | 0.0 | 72 | Invention Example |
| 5 | B | 480 | 0.9 | 0.4 | 0.5 | 9.8 | 11 | Comparative Example |
| 6 | B | 400 | 10.0 | 4.8 | 3.0 | 11.5 | 9 | Comparative Example |
| 7 | C | 350 | 3.5 | 21.4 | 2.5 | 0.1 | 65 | Invention Example |
| 8 | C | 395 | 4.2 | 5.5 | 1.2 | 0.0 | 48 | Invention Example |
| 9 | C | 460 | 1.2 | 0.8 | 1.2 | 2.6 | 12 | Comparative Example |
| 10 | C | 550 | 0.5 | 0.8 | 1.2 | 21.0 | 5 | Comparative Example |
| 11 | D | 485 | 0.2 | 0.4 | 1.5 | 0.0 | 64 | Invention Example |
| 12 | D | 360 | 8.0 | 15.8 | 0.8 | 12.9 | 14 | Comparative Example |
| 13 | E | 310 | 24.0 | 71.0 | 24.0 | 0.0 | 43 | Invention Example |
| 14 | E | 498 | 1.5 | 0.3 | 2.5 | 3.2 | 5 | Comparative Example |
| 15 | E | 440 | 3.0 | 1.4 | 3.6 | 6.5 | 3 | Comparative Example |
| 16 | F | 425 | 1.0 | 2.2 | 4.0 | 0.0 | 81 | Invention Example |
| 17 | F | 481 | 1.0 | 0.4 | 2.5 | 8.9 | 2 | Comparative Example |
| 18 | F | 400 | 3.5 | 4.8 | 0.1 | 2.9 | 14 | Comparative Example |
| 19 | G | 325 | 24.0 | 45.3 | 2.4 | 0.0 | 38 | Invention Example |
| 20 | G | 475 | 0.3 | 0.5 | 4.0 | 0.0 | 66 | Invention Example |
| 21 | G | 475 | 8.0 | 0.5 | 0.2 | 21.6 | 3 | Comparative Example |
| 22 | H | 465 | 0.2 | 0.7 | 10.0 | 0.2 | 75 | Invention Example |
| 23 | H | 475 | 2.2 | 0.5 | 1.5 | 3.5 | 9 | Comparative Example |
| 24 | H | 433 | 3.5 | 1.8 | 3.9 | 5.9 | 8 | Comparative Example |
| 25 | H | 520 | 3.5 | 1.8 | 3.9 | 30.0 | 2 | Comparative Example |
| 26 | I | 461 | 1.5 | 0.8 | 2.5 | 7.5 | 14 | Comparative Example |
| 27 | I | 475 | 0.3 | 0.5 | 1.5 | 0.9 | 68 | Invention Example |
| 28 | I | 466 | 0.2 | 0.7 | 0.9 | 2.2 | 19 | Comparative Example |
| 29 | J | 387 | 0.2 | 7.0 | 5.4 | 0.0 | 57 | Invention Example |
| 30 | J | 460 | 0.3 | 0.8 | 3.5 | 0.1 | 49 | Invention Example |
| 31 | J | 449 | 1.2 | 1.1 | 4.9 | 3.9 | 8 | Comparative Example |
| 32 | K | 484 | 0.2 | 0.4 | 9.5 | 0.1 | 39 | Invention Example |
| 33 | K | 385 | 3.5 | 7.5 | 0.7 | 2.5 | 17 | Comparative Example |
| 34 | K | 461 | 3.5 | 0.8 | 0.2 | 18.7 | 6 | Comparative Example |
| 35 | L | 495 | 0.2 | 0.3 | 3.5 | 0.2 | 5 | Comparative Example |
| 36 | L | 352 | 2.5 | 20.1 | 1.6 | 0.3 | 4 | Comparative Example |
| 37 | L | 443 | 2.5 | 1.3 | 0.3 | 12.5 | 3 | Comparative Example |

X: The number density of Cu clusters having the maximum diameters of 5 nm or less ($\times 10^{13}$ counts/mm$^2$)

As is clear from Table 10, according to the invention examples to which the invention was applied, a hot-rolled ferritic stainless steel sheet, in which the toughness of the hot-rolled steel sheet is satisfactory, that is, the cold cracking properties are excellent, can be obtained.

On the other hand, in all of comparative examples deviated from the invention examples, the Charpy impact value was low. From this result, it can be understood that the toughness of the hot-rolled steel sheet in the comparative examples decreased.

In Test Nos. 10 and 25, since the coiling temperature T was too high, generation of the Cu clusters was not sufficiently suppressed. As a result, the number density greatly increased. It was considered that the toughness of the hot-rolled steel sheet decreased due to the increased number density.

In Test Nos. 2, 5, 6, 9, 14, 15, 17, 21, 23, 24, 25, 26, 31, 34, and 37, the time t, which was taken after coiling of the hot-rolled steel sheet and until the hot-rolled steel sheet was immersed in the water bath, was longer than the time tc that was the upper limit time. Therefore, generation of the Cu clusters proceeded for the lengthened time; and thereby, the number density of the Cu clusters increased. As a result, it was considered that the Charpy impact value decreased.

In all of Test Nos. 3, 5, 12, 18, 21, 28, 33, 34, and 37, since the immersion time was shorter by one hour; and therefore, the cooling of the hot-rolled steel sheet was not sufficient, and suppression of the generation of the Cu cluster was not sufficient. As a result, it is considered that the toughness of the hot-rolled steel sheet decreased.

In Test Nos. 35 and 36, the number density of the Cu cluster was suppressed to be low, but the content of Cr in the steel sheet was too large; and therefore, it is considered that the toughness decreased.

In addition, Steel No. J was used, and coiling was conducted at a various coiling temperature T. Then the time t, which was taken until the J steel was immersed in the water bath, was varied, and Steel No. J was immersed in the water bath for two hours. Next, the toughness was evaluated. FIG. 1 shows the evaluation results. x represents a case in which the Charpy impact value was less than 20 J/cm$^2$, and the toughness was poor. ○ represents a case in which the Charpy impact value was 20 J/cm$^2$ or more, and the toughness was satisfactory.

Figure 9:
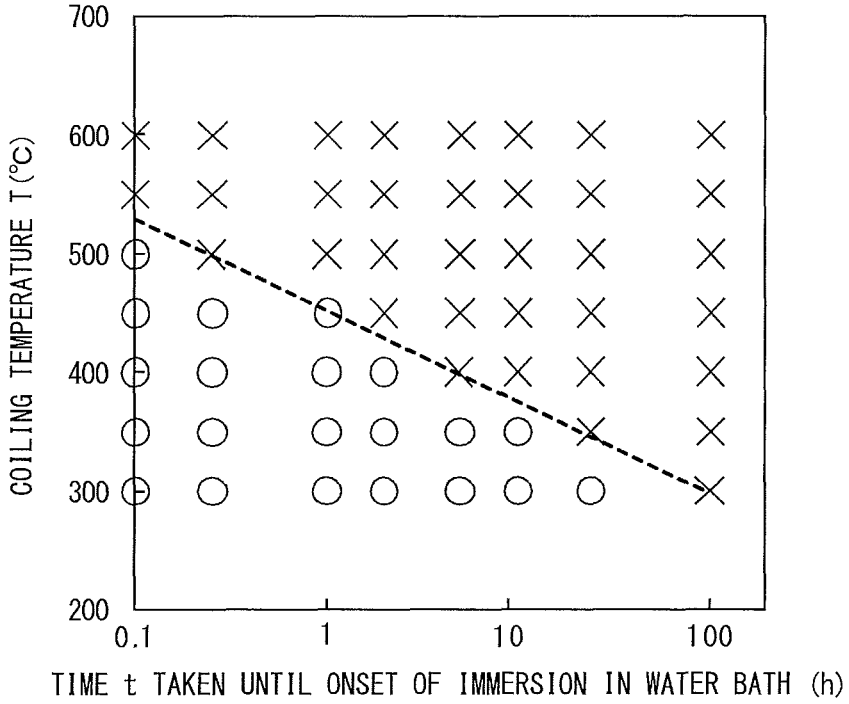
FIG. 9 is a graph showing a relationship between a coiling temperature, a time taken until the steel sheet is immersed in a water bath, and toughness of a hot-rolled ferritic stainless steel sheet according to an embodiment.

In FIG. 9, a straight line indicated by a dotted line represents a boundary between the poor toughness and the satisfactory toughness, and the straight line shows a relationship between the coiling temperature T and the upper limit tc of a time which is taken from a point at which the coiling is performed after reaching the coiling temperature T until the onset of the immersion in the water bath, and the relationship is represented by Expression (3). Furthermore, it could be understood that even when the same graph is drawn using other kinds of steels, a straight line showing the same boundary was obtained.

INDUSTRIAL APPLICABILITY

As is clear from the above description, according to the method for producing the hot-rolled ferritic stainless steel sheet of the invention, the expensive alloy elements such as Nb and Mo are substituted with Cu. Accordingly, in a stainless steel sheet having high-temperature strength, the toughness of the hot-rolled steel sheet can be increased. As a result, highly efficient production can be realized. In addition, particularly, when a material to which the invention is applied is applied to members for an exhaust system, social contribution can be enhanced such as an environmental measure or the like which is obtained by reduction in the cost of components or reduction in weight. That is, the invention has sufficient industrial applicability.

The invention claimed is:

1. A hot-rolled ferritic stainless steel sheet excellent in cold cracking properties having a steel composition containing, in terms of % by mass:

0.0010% to 0.010% of C;
0.01% to 1.0% of Si;
0.01% to 2.00% of Mn;
less than 0.040% of P;
0.010% or less of S;
10.0% to 30.0% of Cr;
1.0% to 2.0% of Cu;
0.001% to 0.10% or 0.50% to 3.0% of Al; and
0.0030% to 0.0200% of N,
with the balance being Fe and unavoidable impurities,
wherein in crystal grains, a number density of Cu clusters, which consist of Cu and have maximum diameters of 5 nm or less, is in a range of less than $2\times10^{13}$ counts/mm$^3$.

2. The hot-rolled ferritic stainless steel sheet excellent in cold cracking properties according to claim 1, which further contains one or more selected from a group consisting of, in terms of % by mass, 0.10% to 0.70% of Nb, and 0.05% to 0.30% of Ti in such a manner that the following relation (Expression 2) is fulfilled, $$Nb/93+Ti/48\geq C/12+N/14 \quad \text{(Expression 2).}$$

3. The hot-rolled ferritic stainless steel sheet excellent in cold cracking properties according to claim 1, which further contains one or more selected from a group consisting of, in terms of % by mass:

0.1% to 1.0% of Mo;
0.1% to 1.0% of Ni; and
0.0001% to 0.0025% of B.

4. A method for producing a hot-rolled ferritic stainless steel sheet excellent in cold cracking properties, the method comprising:

a process of subjecting a slab, which is obtained by casting a ferritic stainless steel having a steel composition according to claim 1 so as to form a hot-rolled steel sheet;

a process of coiling the hot-rolled steel sheet into a coil shape under a condition where a coiling temperature T is set to be in a range of 300° C. to 500° C. after the hot rolling; and a process of immersing the hot-rolled steel sheet having a coil shape into a water bath for 1 hour or more, and taking out the hot-rolled steel sheet from the water bath after the immersing, wherein after the process of coiling the hot-rolled steel sheet into the coil shape, the hot-rolled steel sheet is immersed in the water bath within a time tc (h) that fulfills the following relation (Expression 3), $$tc=10\hat{}((452-T)/76.7) \quad \text{(Expression 3).}$$

5. The hot-rolled ferritic stainless steel sheet excellent in cold cracking properties according to claim 2, which further contains one or more selected from a group consisting of, in terms of % by mass:

0.1% to 1.0% of Mo;
0.1% to 1.0% of Ni; and
0.0001% to 0.0025% of B.

6. A method for producing a hot-rolled ferritic stainless steel sheet excellent in cold cracking properties, the method comprising:

a process of subjecting a slab, which is obtained by casting a ferritic stainless steel having a steel composition according to claim 2 so as to form a hot-rolled steel sheet;

a process of coiling the hot-rolled steel sheet into a coil shape under a condition where a coiling temperature T is set to be in a range of 300° C. to 500° C. after the hot rolling; and a process of immersing the hot-rolled steel sheet having a coil shape into a water bath for 1 hour or more, and taking out the hot-rolled steel sheet from the water bath after the immersing, wherein after the process of coiling the hot-rolled steel sheet into the coil shape, the hot-rolled steel sheet is immersed in the water bath within a time tc (h) that fulfills the following relation (Expression 3), $$tc=10\hat{}((452-T)/76.7) \quad \text{(Expression 3).}$$

7. A method for producing a hot-rolled ferritic stainless steel sheet excellent in cold cracking properties, the method comprising:

a process of subjecting a slab, which is obtained by casting a ferritic stainless steel having a steel composition according to claim 3 so as to form a hot-rolled steel sheet;

a process of coiling the hot-rolled steel sheet into a coil shape under a condition where a coiling temperature T is set to be in a range of 300° C. to 500° C. after the hot rolling; and a process of immersing the hot-rolled steel sheet having a coil shape into a water bath for 1 hour or more, and taking out the hot-rolled steel sheet from the water bath after the immersing, wherein after the process of coiling the hot-rolled steel sheet into the coil shape, the hot-rolled steel sheet is immersed in the water bath within a time tc (h) that fulfills the following relation (Expression 3), $$tc=10\hat{}((452-T)/76.7) \quad \text{(Expression 3).}$$

8. A method for producing a hot-rolled ferritic stainless steel sheet excellent in cold cracking properties, the method comprising:

a process of subjecting a slab, which is obtained by casting a ferritic stainless steel having a steel composition according to claim 5 so as to form a hot-rolled steel sheet;

a process of coiling the hot-rolled steel sheet into a coil shape under a condition where a coiling temperature T is set to be in a range of 300° C. to 500° C. after the hot rolling; and a process of immersing the hot-rolled steel sheet having a coil shape into a water bath for 1 hour or more, and taking out the hot-rolled steel sheet from the water bath after the immersing, wherein after the process of coiling the hot-rolled steel sheet into the coil shape, the hot-rolled steel sheet is immersed in the water bath within a time tc (h) that fulfills the following relation (Expression 3), $$tc=10\hat{}((452-T)/76.7) \quad \text{(Expression 3).}$$

* * * * *